US009201354B2

(12) United States Patent
Ju

(10) Patent No.: US 9,201,354 B2
(45) Date of Patent: Dec. 1, 2015

(54) IMAGE FORMING APPARATUS AND CONTROL METHOD THEREOF

(71) Applicant: Samsung Electronics Co., Ltd., Suwon-si (KR)

(72) Inventor: Jeong Yong Ju, Suwon-Si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 14 days.

(21) Appl. No.: 14/061,246

(22) Filed: Oct. 23, 2013

(65) Prior Publication Data

US 2014/0119760 A1 May 1, 2014

(30) Foreign Application Priority Data

Oct. 25, 2012 (KR) ..... 10-2012-0119338

(51) Int. Cl.

*G03G 15/16* (2006.01)
*G03G 15/20* (2006.01)
*G03G 15/01* (2006.01)

(52) U.S. Cl.

CPC ..... *G03G 15/1665* (2013.01); *G03G 15/0136* (2013.01); *G03G 15/1615* (2013.01)

(58) Field of Classification Search

CPC ..... G03G 15/1665; G03G 15/1615; G03G 15/0136
USPC ..... 399/66, 302, 299, 308
See application file for complete search history.

(56) References Cited

U.S. PATENT DOCUMENTS

2007/0059054 A1* 3/2007 Furukawa ..... 399/302

FOREIGN PATENT DOCUMENTS

| | | |
|---|---|---|
| JP | 2002-173246 | 6/2002 |
| JP | 2005-221667 | 8/2005 |
| JP | 2006-72254 | 3/2006 |
| JP | 2006-139063 | 6/2006 |
| JP | 2006-308758 | 11/2006 |
| JP | 2008-185612 | 8/2008 |
| JP | 2010-145935 | 7/2010 |

OTHER PUBLICATIONS

International Search Report issued Feb. 27, 2014 in International Patent Application No. PCT/KR2013/009470.

* cited by examiner

*Primary Examiner* — Billy Lactaoen
(74) *Attorney, Agent, or Firm* — Staas & Halsey LLP

(57) ABSTRACT

Disclosed herein are an image forming apparatus and a control method thereof. The image forming apparatus includes a plurality of photoconductors, a transfer belt, a plurality of transfer rollers arranged in parallel with the plurality of photoconductors, and a controller rotating the transfer belt under the condition that at least one of the plurality of transfer rollers presses the transfer belt toward at least one of the plurality of photoconductors, interrupting power transmitted to the transfer belt to cause at least another of the plurality of transfer rollers to press the transfer belt toward at least another of the plurality of photoconductors, standing by until rotation of the transfer belt is stopped, after interruption of the power, and controlling the at least another of the plurality of transfer rollers so as to press the transfer belt toward the at least another of the plurality of photoconductors.

24 Claims, 15 Drawing Sheets

(A) READY MODE (B) COLOR MODE

IMAGE FORMING APPARATUS AND CONTROL METHOD THEREOF

CROSS-REFERENCE TO RELATED APPLICATION

This application claims the priority benefit of Korean Patent Application No. 10-2012-0119338, filed on Oct. 25, 2012 in the Korean Intellectual Property Office, the disclosure of which is incorporated herein by reference.

BACKGROUND

1. Field

Embodiments relate to an image forming apparatus having a transfer device transferring developing agents from a plurality of developing units to paper, and a control method thereof.

2. Description of the Related Art

An electrophotographic image forming apparatus, for example, a laser printer, a digital copier, or a multi-function apparatus, refers to an apparatus which radiates light to photoconductors charged with a designated electric potential to form electrostatic latent images on the outer surfaces of the photoconductors, supplies toners, i.e., developing agents, to the electrostatic latent images to form visible images, and transfers and fixes the visible images to a printing medium to print the images.

A color image forming apparatus includes a plurality of photoconductors converting electrostatic latent images into visible images through developing agents, a transfer belt to which the visible images formed by the plurality of photoconductors are transferred, a transfer belt driving motor to rotate the transfer belt, and a plurality of transfer rollers pressing the transfer belt toward the photoconductors and causing the transfer belt to come into contact with the photoconductors so as to transfer the visible images on the photoconductors to the transfer belt.

If the transfer belt in the rotating state contacts the photoconductors when one or more transfer rollers press the transfer belt so as to achieve contact between the transfer belt and the photoconductors, the transfer belt, the transfer rollers, and the photoconductors may be damaged, and a printed matter may be contaminated due to triboelectrification caused by contact between the transfer belt in the rotating state and the photoconductors.

SUMMARY

In an aspect of one or more embodiments, there is provided an image forming apparatus and a control method thereof in which a transfer roller presses a transfer belt after stoppage of the transfer belt if the transfer roller presses the transfer belt to come into contact with a photoconductor, and thus contact between the transfer belt in the rotating state and the photoconductor may be prevented.

In an aspect of one or more embodiments, there is provided a control method of an image forming apparatus which has a plurality of transfer rollers arranged in parallel with a plurality of photoconductors such that a transfer belt is interposed between the plurality of transfer rollers and the plurality of photoconductors and pressing the transfer belt to come into contact with the plurality of photoconductors, includes rotating the transfer belt under the condition that the plurality of transfer rollers does not press the transfer belt toward the plurality of photoconductors, interrupting power transmitted to the transfer belt to cause the plurality of transfer rollers to press the transfer belt, standing by until rotation of the transfer belt is stopped, after interruption of the power, and controlling the plurality of transfer rollers so as to press the transfer belt toward the plurality of photoconductors, when rotation of the transfer belt is stopped.

The standing by may be carried out for a predetermined time until rotation of the transfer belt is stopped.

The predetermined time may be time for which the transfer belt is rotated due to rotational inertia after interruption of the power transmitted to the transfer belt.

In a ready mode, the pressing state of the plurality of transfer rollers may be released so that all of the plurality of transfer rollers does not contact the plurality of photoconductors, and in a color mode, transfer rollers participating in formation of a color image among the plurality of transfer rollers may press the transfer belt so as to contact corresponding photoconductors.

In an aspect of one or more embodiments, there is provided a control method of an image forming apparatus which has a plurality of transfer rollers arranged in parallel with a plurality of photoconductors such that a transfer belt is interposed between the plurality of transfer rollers and the plurality of photoconductors and pressing the transfer belt to come into contact with the plurality of photoconductors, includes rotating the transfer belt under the condition that the plurality of transfer rollers presses the transfer belt toward the plurality of photoconductors, interrupting power transmitted to the transfer belt to release the pressed state of the transfer belt by the plurality of transfer rollers, standing by until rotation of the transfer belt is stopped, after interruption of the power, and releasing the pressed state of the transfer belt by the plurality of transfer rollers, when rotation of the transfer belt is stopped.

The standing by may be carried out for a predetermined time until rotation of the transfer belt is stopped.

The predetermined time may be time taken to stop rotation of the transfer belt due to rotational inertia after interruption of the power transmitted to the transfer belt.

In a ready mode, the pressing state of the plurality of transfer rollers may be released so that all of the plurality of transfer rollers does not contact the plurality of photoconductors, and in a color mode, transfer rollers participating in formation of a color image among the plurality of transfer rollers may press the transfer belt so as to contact corresponding photoconductors.

In an aspect of one or more embodiments, there is provided a control method of an image forming apparatus which has a plurality of transfer rollers arranged in parallel with a plurality of photoconductors such that a transfer belt is interposed between the plurality of transfer rollers and the plurality of photoconductors and pressing the transfer belt to come into contact with the plurality of photoconductors, includes rotating the transfer belt under the condition that at least one of the plurality of transfer rollers presses the transfer belt toward at least one of the plurality of photoconductors, interrupting power transmitted to the transfer belt to cause at least another of the plurality of transfer rollers to press the transfer belt toward at least another of the plurality of photoconductors, standing by until rotation of the transfer belt is stopped, after interruption of the power, and controlling the at least another of the plurality of transfer rollers so as to press the transfer belt toward the at least another of the plurality of photoconductors, when until rotation of the transfer belt is stopped.

The standing by may be carried out for a predetermined time until rotation of the transfer belt is stopped.

The predetermined time may be time taken to stop rotation of the transfer belt due to rotational inertia after interruption of the power transmitted to the transfer belt.

In a ready mode, the pressing state of the plurality of transfer rollers may be released so that all of the plurality of transfer rollers does not contact the plurality of photoconductors, in a mono mode, only a transfer roller participating in formation of a mono image among the plurality of transfer rollers may press the transfer belt so as to contact a corresponding photoconductor, and in a color mode, transfer rollers participating in formation of a color image among the plurality of transfer rollers may press the transfer belt so as to contact corresponding photoconductors.

Mode switching may be carried out in the order of the ready mode, the mono mode, and the color mode.

In an aspect of one or more embodiments, there is provided an image forming apparatus includes a plurality of photoconductors, a transfer belt, a plurality of transfer rollers arranged in parallel with the plurality of photoconductors such that the transfer belt is interposed between the plurality of transfer rollers and the plurality of photoconductors and pressing the transfer belt to come into contact with the plurality of photoconductors, and a controller rotating the transfer belt under the condition that at least one of the plurality of transfer rollers presses the transfer belt toward at least one of the plurality of photoconductors, interrupting power transmitted to the transfer belt to cause at least another of the plurality of transfer rollers to press the transfer belt toward at least another of the plurality of photoconductors, standing by until rotation of the transfer belt is stopped, after interruption of the power, and controlling the at least another of the plurality of transfer rollers so as to press the transfer belt toward the at least another of the plurality of photoconductors.

The controller may stand by for a predetermined time until rotation of the transfer belt is stopped.

The predetermined time may be time taken to stop rotation of the transfer belt due to rotational inertia after interruption of the power transmitted to the transfer belt.

In a ready mode, the pressing state of the plurality of transfer rollers may be released so that all of the plurality of transfer rollers does not contact the plurality of photoconductors, in a mono mode, only a transfer roller participating in formation of a mono image among the plurality of transfer rollers may press the transfer belt so as to contact a corresponding photoconductor, and in a color mode, transfer rollers participating in formation of a color image among the plurality of transfer rollers may press the transfer belt so as to contact corresponding photoconductors.

Mode switching may be carried out in the order of the ready mode, the mono mode, and the color mode.

In an aspect of one or more embodiments, there is provided a control method of an image forming apparatus which has a plurality of transfer rollers arranged in parallel with a plurality of photoconductors such that a transfer belt is interposed between the plurality of transfer rollers and the plurality of photoconductors and pressing the transfer belt to come into contact with the plurality of photoconductors, includes forcibly releasing the contact state between the transfer belt and the plurality of photoconductors by pressing the transfer belt using the plurality of transfer rollers, before first warm-up after being powered-on of the image forming apparatus is performed, and performing the first warm-up, when the contact state between the transfer belt and the plurality of photoconductors is released.

In an aspect of one or more embodiments, there is provided an image forming apparatus includes a plurality of photoconductors, a transfer belt, a plurality of transfer rollers arranged in parallel with the plurality of photoconductors such that the transfer belt is interposed between the plurality of transfer rollers and the plurality of photoconductors and pressing the transfer belt to come into contact with the plurality of photoconductors, and a controller forcibly releasing the contact state between the transfer belt and the plurality of photoconductors by pressing the transfer belt through the plurality of transfer rollers, before first warm-up after being powered on of the image forming apparatus is performed.

The controller may perform the first warm-up, when the contact state between the transfer belt and the plurality of photoconductors is released.

In an aspect of one or more embodiments, there is provided a control method of an image forming apparatus which has a plurality of transfer rollers arranged in parallel with a plurality of photoconductors such that a transfer belt is interposed between the plurality of transfer rollers and the plurality of photoconductors and pressing the transfer belt to come into contact with the plurality of photoconductors, includes rotating the transfer belt under the condition that the plurality of transfer rollers does not press the transfer belt toward the plurality of photoconductors, interrupting power transmitted to the transfer belt to cause the plurality of transfer rollers to press the transfer belt, reducing the rotational speed of the transfer belt due to rotational inertia by controlling a transfer belt braking part, standing by until rotation of the transfer belt is stopped, and controlling the plurality of transfer rollers so as to press the transfer belt toward the plurality of photoconductors or to release the pressed state of the transfer belt by the plurality of transfer rollers, when rotation of the transfer belt is stopped.

The transfer belt braking part may serve to reduce the rotational speed of a transfer belt driving motor to rotate the transfer belt.

The transfer belt braking part may serve to reduce the rotational speed of a driving roller to rotate the transfer belt.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Figure 1:
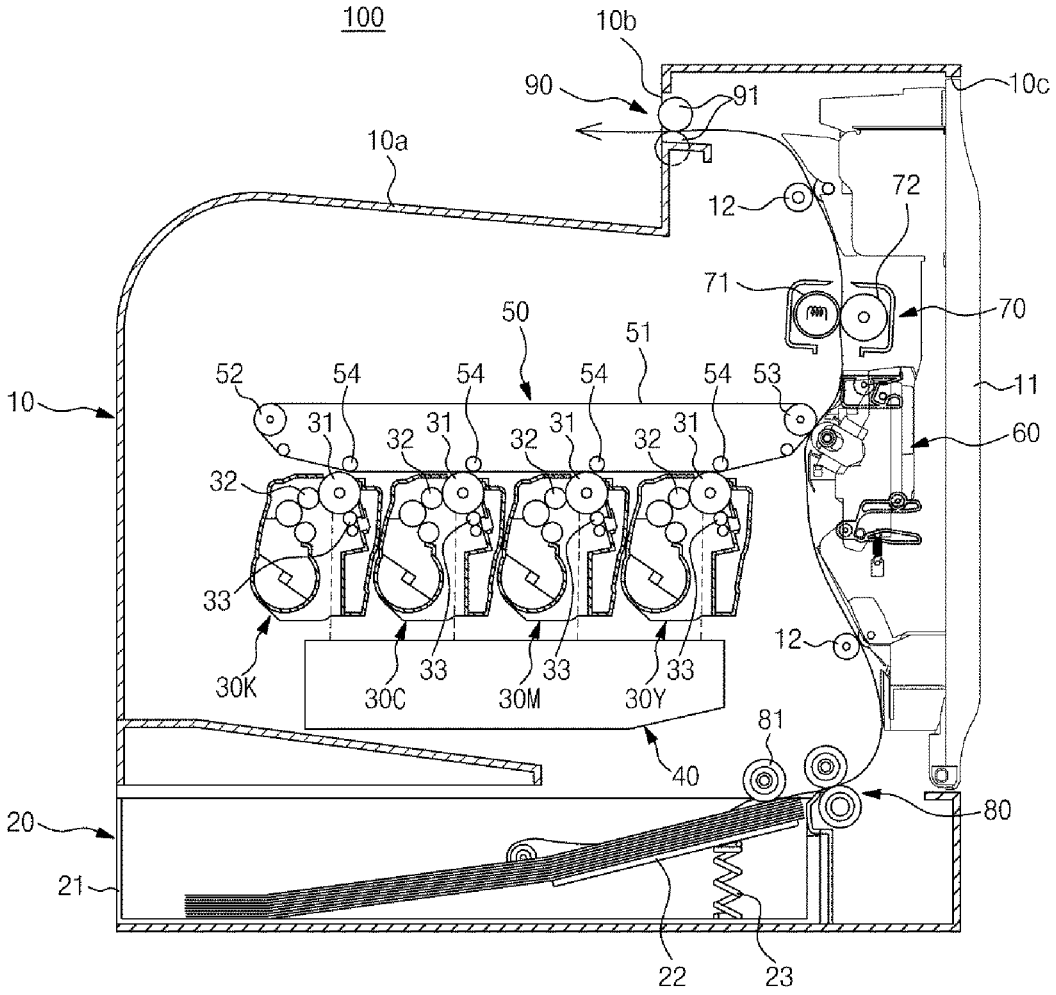
FIG. 1 is a sectional view of an image forming apparatus in accordance with an embodiment.

Reference will now be made in detail to embodiments, examples of which are illustrated in the accompanying drawings, wherein like reference numerals refer to like elements throughout.

FIG. 1 is a sectional view of an image forming apparatus in accordance with an embodiment. As exemplarily shown in FIG. 1, an image forming apparatus 100 in accordance with an embodiment includes a main body 10 forming the external appearance of the image forming apparatus 100, a printing medium storage unit 20 in which printing media are stored, a plurality of developing units (developers) 30C, 30M, 30Y, and 30K developing electrostatic latent images into visible images according to color through developing agents (for example, toners), an exposure unit 40 radiating light to photoconductors 31 of the charged developing units 30C, 30M, 30Y, and 30K to form the electrostatic latent images, a transfer device including a first transfer unit 50 receiving a printing medium from the printing medium storage unit 20 and a second transfer unit 60 transferring the visible images formed on the photoconductors to the printing medium, and a fixing unit 70 fixing the developing agents, transferred to the printing medium, to the printing medium.

The main body 10 is provided with a load part 10*a*, on which printing media having completed image formation loaded. The load part 10*a* is formed on the upper portion of the main body 10. An exit hole 10*b* through which the printing media having completed image formation exits the main body 10 is provided at one side of the load part 10*a*. An opening 10*c* to repair and replace parts within the main body 10 or to replace consumables within the main body 10 is provided at one side of the main body 10, and a side cover 11 to open and close the opening 10*c* is installed. In an embodiment, the side cover 11 is configured such that the lower end of the side cover 11 is rotatably installed on the main body 10, and is rotated about the lower end of the side cover 11, thus opening and closing the opening 10*c*.

The printing medium storage unit 20 includes a printing medium cassette 21 movably installed on the main body 10, a knock-up plate 22 arranged within the printing medium cassette 21 such that the printing media are loaded on the knock-up plate 22, and an elastic member 23 elastically supporting the knock-up plate 22.

Each of the developing units 30C, 30M, 30Y, and 30K includes the photoconductor 31 provided with the charged surface on which an electrostatic latent image is formed by the exposure unit 40, a developing roller 32 supplying the developing agent to the photoconductor 31, and a charging unit 33 charging the surface of the photoconductor 31.

In an embodiment, four developing units 30C, 30M, 30Y, and 30K, each of which stores one of cyan (C), magenta (M), yellow (Y), and black (K) developing agents to form visible images of cyan (C), magenta (M), yellow (Y), and black (K) are provided. The four developing units 30C, 30M, 30Y, and 30K are arranged in parallel under the transfer device.

The exposure unit 40 radiates light containing image information to the photoconductors 31 of the developing units 30C, 30M, 30Y, and 30K, and thus forms electrostatic latent images on the surfaces of the photoconductors 31.

The transfer device includes a first transfer unit 50 to which the visible images formed by the developing agents from the developing units 30C, 30M, 30Y, and 30K are transferred, and a second transfer unit 60 transferring the visible images on the first transfer unit 50 to a printing medium.

The fixing unit 70 includes a heating roller 71 generating heat, and a pressure roller 72 provided with an outer circumferential surface formed of an elastically deformable material and pressing a printing medium to the outer circumferential surface of the heating roller 71.

Further, a pick-up unit 80 arranged on the printing medium storage unit 20 to pick up the printing media loaded on the knock-up plate 22 sheet by sheet, feed rollers 12 guiding the printing media picked up by the pick-up unit 80 upwardly, and an exit unit 90 located above the fixing unit 70 and arranged adjacent to the exit hole 10*b* to discharge the printing medium having passed through the fixing unit 70 to the outside of the main body 10 through the exit hole 10*b* are arranged within the main body 10. The pick-up unit 80 includes a pick-up roller 81 to pick up the printing medium on the knock-up plate 22 sheet by sheet, and the exit unit 90 includes a pair or exit rollers 91 arranged at the inside of the exit hole 10*b*.

In the image forming apparatus 100 having the above structure, the first transfer unit 50 is arranged within the main body 10, and includes a transfer belt 51 to which the developing agents developed into the visible images on the photoconductors 31 of the developing units 30C, 30M, 30Y, and 30K are transferred so as to overlap one another. The first transfer unit further includes driving roller 52 and a driven roller 53 arranged at both sides of the inside of the transfer belt 51 to rotate the transfer belt 51. The first transfer unit 50 further includes a plurality of transfer rollers 54 arranged opposite to the photoconductors 31 of the developing units 30C, 30M, 30Y, and 30K. The transfer belt 51 is interposed between the transfer rollers 54 and the photoconductors 31 and transfers visible images formed on the photoconductors 31 to the transfer belt 51. The transfer unit 50 further includes a transfer belt frame (not shown) on which both ends of the transfer rollers 54, the driving roller 52 and the driven roller 53 are rotatably installed.

Figure 2:
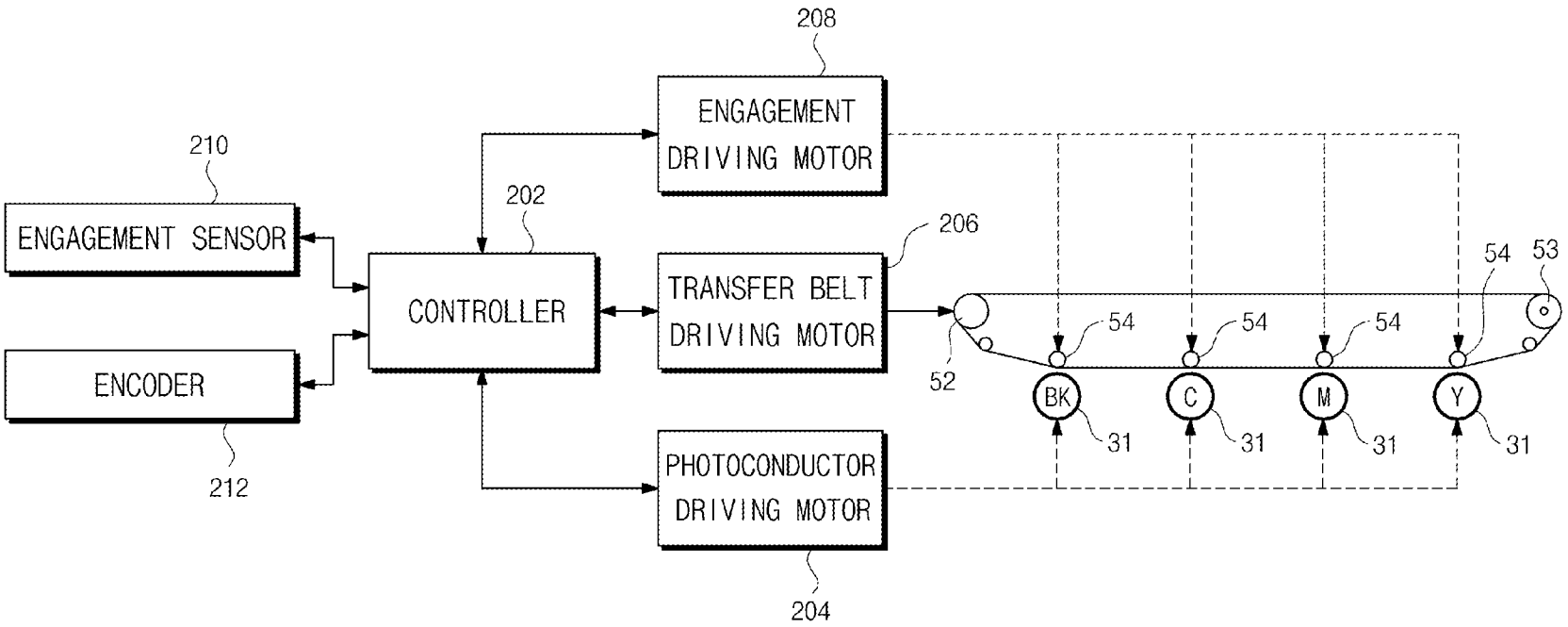
FIG. 2 is a view illustrating a control system of an image forming apparatus in accordance with an embodiment.
Figure 3:
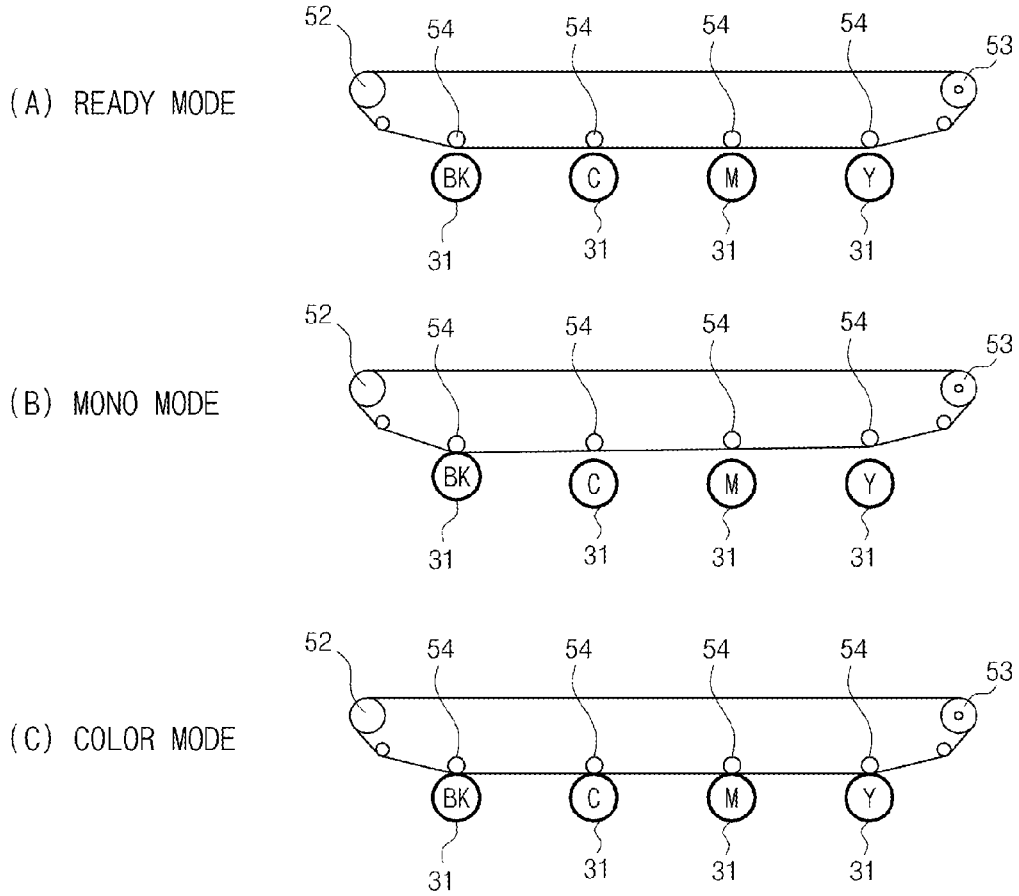
FIG. 3, (A) through (C), are views illustrating operating modes regarding a transfer device and photoconductors of the image forming apparatus shown in FIG. 1.

FIG. 2 is a view illustrating a control system of an image forming apparatus in accordance with an embodiment. As exemplarily shown in FIG. 2, a controller 202 controlling the overall operation of the image forming apparatus 100 is electrically connected to a photoconductor driving motor 204, a transfer belt driving motor 206, and an engagement driving motor 208 so as to be communicable with the photoconductor driving motor 204, the transfer belt driving motor 206, and the engagement driving motor 208. The controller 202 participates in rotation and stoppage of the photoconductors 31 through control of the photoconductor driving motor 204. Further, the controller 202 participates in rotation and stoppage of the driving roller 52 and the transfer belt 51 through control of the transfer belt driving motor 206. Further, the controller 202 participates in engagement and disengagement of the transfer rollers 54 through control of the engagement driving motor 208. In an example, engagement refers to a state in which the transfer roller 54 presses the transfer belt 51 and thus the transfer belt 51 contacts the photoconductor 31, and disengagement refers to a state in which pressing of the transfer belt 51 by the transfer roller 54 is released and thus contact between the transfer belt 51 and the photoconductor 31 is released (with reference to FIG. 3). All the four transfer rollers 54 and all the four photoconductors 31 may be engaged with or disengaged from each other, or some of the four transfer rollers 54 and some of the four photoconductors 31 may be engaged with or disengaged from each other. Further, the controller 202 is electrically connected to an engagement sensor 210 and an encoder 212 so as to communicate with the engagement sensor 210 and the encoder 212. The engagement sensor 210 serves to detect the engagement states and disengagement states among the transfer rollers 54, the transfer belt 51 and photoconductors 31, and provides the detected state information to the controller 202. The encoder 212 is an encoder of the transfer belt driving motor 206. The encoder 212 detects the rotating state of the transfer belt driving motor 206, and provides the rotating state information to the controller 202.

FIGS. 3(A) to 3(C) are views illustrating operating modes regarding the transfer device and the photoconductors of the image forming apparatus shown in FIG. 1. First, FIG. 3(A) illustrates a ready mode prior to image formation. In the ready mode, all the transfer rollers 54, the transfer belt 51, and all the opposite photoconductors 31 are disengaged from one another. In an embodiment, opposite refers to that the four transfer rollers 54 and the four photoconductors 31 corresponding to each other. In the ready mode, image formation is not carried out, and thus, the disengagement state among all of the transfer rollers 54 and all of the photoconductors 31 is maintained.

FIG. 3(B) illustrates a mono mode in which a monochromatic image is formed using a black (BK) developing agent. Since the monochromatic image is formed using only the black (BK) developing agent, the transfer roller 54, the transfer belt 51, and the photoconductor 31 corresponding to black (BK) are engaged with one another, and the transfer rollers 54 and the photoconductors 31 corresponding to cyan (C), magenta (M), and yellow (Y) are disengaged from each other. In the mono mode, the transfer roller 54 and the photoconductor 31 corresponding to black (BK) in the engagement state are rotated, and the photoconductors 31 corresponding to cyan (C), magenta (M), and yellow (Y) are not rotated.

FIG. 3(C) illustrates a color mode in which a color image is formed using black (BK), cyan (C), magenta (M), and yellow (Y) developing agents. In the color mode, all the four transfer rollers 54, the transfer belt 51, and all the four photoconductors 31 corresponding to black (BK), cyan (C), magenta (M), and yellow (Y) are engaged with one another. In the color mode, since black (BK), cyan (C), magenta (M), and yellow (Y) participate in image formation, all the four transfer rollers 54 and all the four photoconductors 31 are rotated.

In the image forming apparatus 100 in accordance with an embodiment, the ready mode, the mono mode, and the color mode may be switched in the order of ' . . . →ready mode→mono mode→color mode→ready mode→mono mode→ . . . '. Further, the ready mode may be switched directly to the mono mode or directly to the color mode. Otherwise, the color mode may be switched directly to the mono mode, or the mono mode may be switched directly to the color mode.

If the mono mode is switched directly to the color mode, the engagement state between only the transfer roller 54 and the photoconductor 31 corresponding to black (BK), as exemplarily shown in FIG. 3(B), is switched to the engagement state between the three transfer rollers 54 and the three photoconductors corresponding to cyan (C), magenta (M), and yellow (Y) in addition to the transfer roller 54 and the photoconductor 31 corresponding to black (BK), as exemplarily shown in FIG. 3(C). Thereby, all the four transfer rollers 54, the transfer belt 51, and all the four photoconductors 31 are engaged with one another. When the state of FIG. 3(B) is switched to the state of FIG. 3(C), stop instructions of the transfer belt driving motor 206 driven to rotate the transfer belt 51 are generated and applied to the transfer belt driving motor 206 to stop the transfer belt driving motor 206, and engagement among the three transfer rollers 54, the transfer belt 51, and the three photoconductors corresponding to cyan (C), magenta (M), and yellow (Y) is carried out.

However, if the stop instructions are applied to the transfer belt driving motor 206 and the transfer roller driving motor 206 is not immediately stopped but is rotated for a designated time due to inertia, the transfer rollers 54 are switched to the engagement state and a band-shaped image may be formed on the transfer rollers 54 due to contact between the transfer belt 51 rotated by rotational inertia of the transfer belt driving motor 206 and the transfer rollers 54 engaged therewith, and such an image may have an unintended influence on an image on a printing medium. In the image forming apparatus in accordance with an embodiment, in order to prevent this band-shaped burn problem, additional switching to the engagement states of the transfer rollers 54 is not executed for a predetermined time (Δms) so that rotational inertia of the transfer belt driving motor 206 completely disappears and the transfer belt driving motor 206 is completely stopped during mode switching. Then, the engagement driving motor 208 is operated after the predetermined (e.g. Δms) has elapsed so that the transfer rollers 54, the transfer belt 51 and the photoconductors 31 are engaged with each other.

Figure 4:
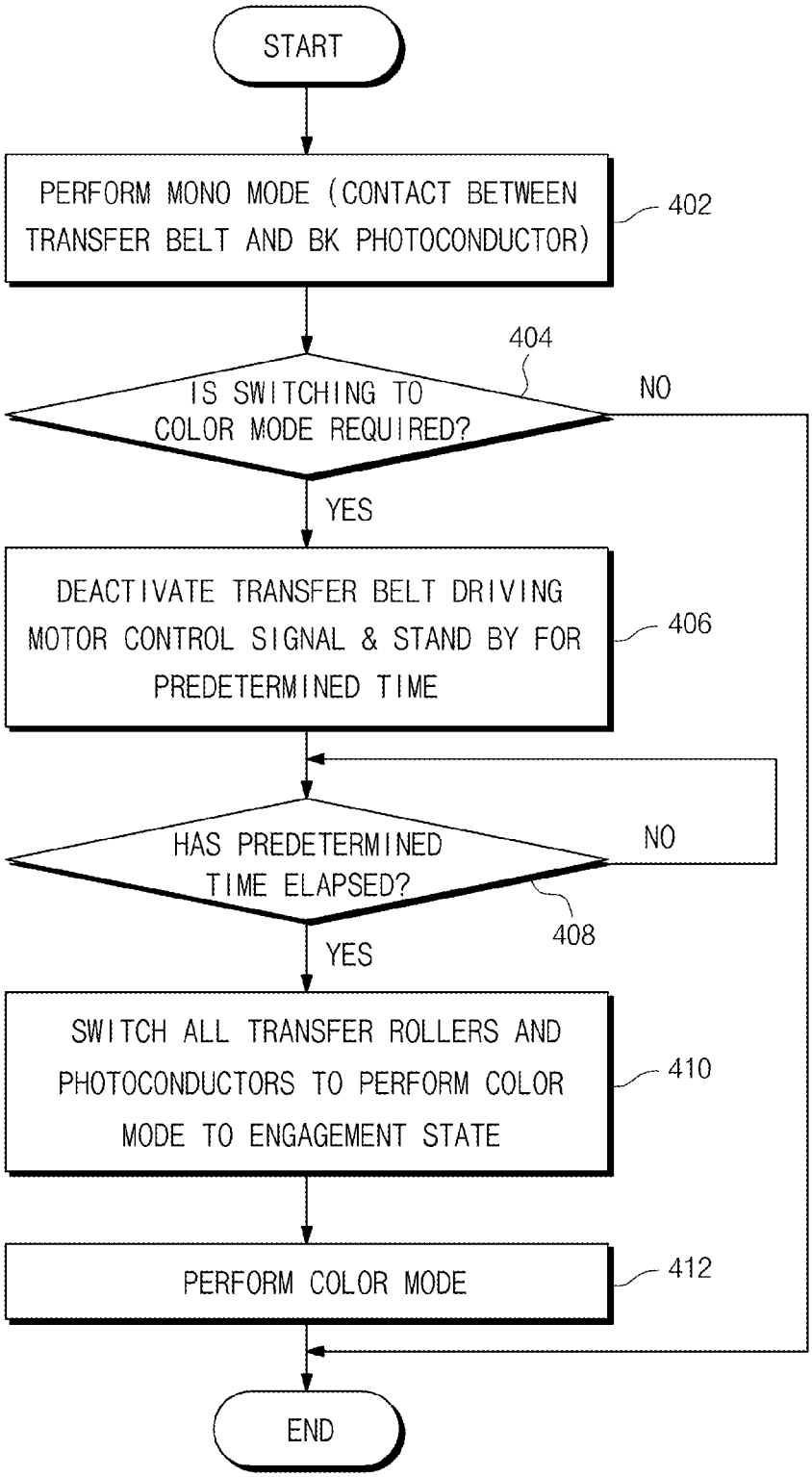
FIG. 4 is a flowchart of a control method of the image forming apparatus in accordance with an embodiment shown in FIG. 2.

FIG. 4 is a flowchart of a control method of the image forming apparatus in accordance with an embodiment. As exemplarily shown in FIG. 4, in order to perform image formation in the mono mode, the controller 202 executes contact between the transfer belt 51 and the BK photoconductor 31 by pressing the transfer belt 51 using the transfer roller 54 corresponding to black (BK) (Operation 402). In such a state, the controller 202 confirms whether or not switching from the mono mode to the color mode is required (Operation 404). In an example, switching to the color mode may be executed to perform image formation in the color mode, or be executed to go through the color mode for switching to the ready mode. In order to switch from the mono mode to the color mode, the controller 202 deactivates a transfer belt driving motor control signal so as to stop rotation of the transfer belt driving motor 206, and, for this purpose, stands by (waits) for a predetermined time (Operation 406). As the transfer belt driving motor control signal is deactivated, rotation of the transfer belt 51 is stopped. At this time, the transfer belt driving motor 206 is not immediately stopped. Instead, the transfer belt driving motor 206 continues to rotate for a designated time due to rotational inertia and is then stopped. Therefore, the controller 202 stands by (waits) for the predetermined time (Δms) until rotational inertia of the transfer belt driving motor 206 is completely eliminated ('No' in Operation 408). When the predetermined time (Δms) has elapsed ('Yes' in Operation 408), the controller 202 switches three transfer rollers 54 and three photoconductors 31 corresponding to cyan (C), magenta (M), and yellow (Y) to form a color image to the engagement state by activating the engagement driving control signal (Operation 410). Because the rotation of the transfer belt driving motor 206 has completely stopped, three transfer rollers 54 and three photoconductors 31 corresponding to cyan (C), magenta (M), and yellow (Y) can now be switched to the engagement state, so that no problem occurs in the color mode. In an example, the predetermined time (Δms) may be determined using the following method.

That is, a time taken to completely stop the transfer belt driving motor 206 from a point of time when the stop instructions are generated is calculated in advance through experimentation, and the calculated time is set as the predetermined time (Δms) so that the controller 202 may refer to the predetermined time (Δms). Alternatively, other methods, through which the time taken to completely stop the transfer belt driving motor 206 from the point of time when the stop instructions are generated may be predicted or measured, may be used. For example, instead of setting of the predetermined time (Δms), complete stoppage of rotation of the transfer belt driving motor 206 may be actually measured from rotating state information of the transfer belt driving motor 206. When complete stoppage of rotation of the transfer belt driving motor 206 is measured, the controller 202 activates the engagement driving motor control signal so that the transfer rollers 54 press the transfer belt 51 and thus the engagement state in which the transfer belt 51 contacts all the photoconductors 31 is formed so as to perform image formation in the color mode (Operation 412).

Through the control method of the image forming apparatus in accordance with an embodiment shown in FIG. 4, although the transfer rollers 54 in the disengagement state are switched to the engagement state under the condition that the transfer belt 51 contacts the photoconductors 31, triboelectrification between the transfer belt 51 and the photoconductors 31 does not occur, and consequently, a band-shaped image is not formed.

Figure 5:
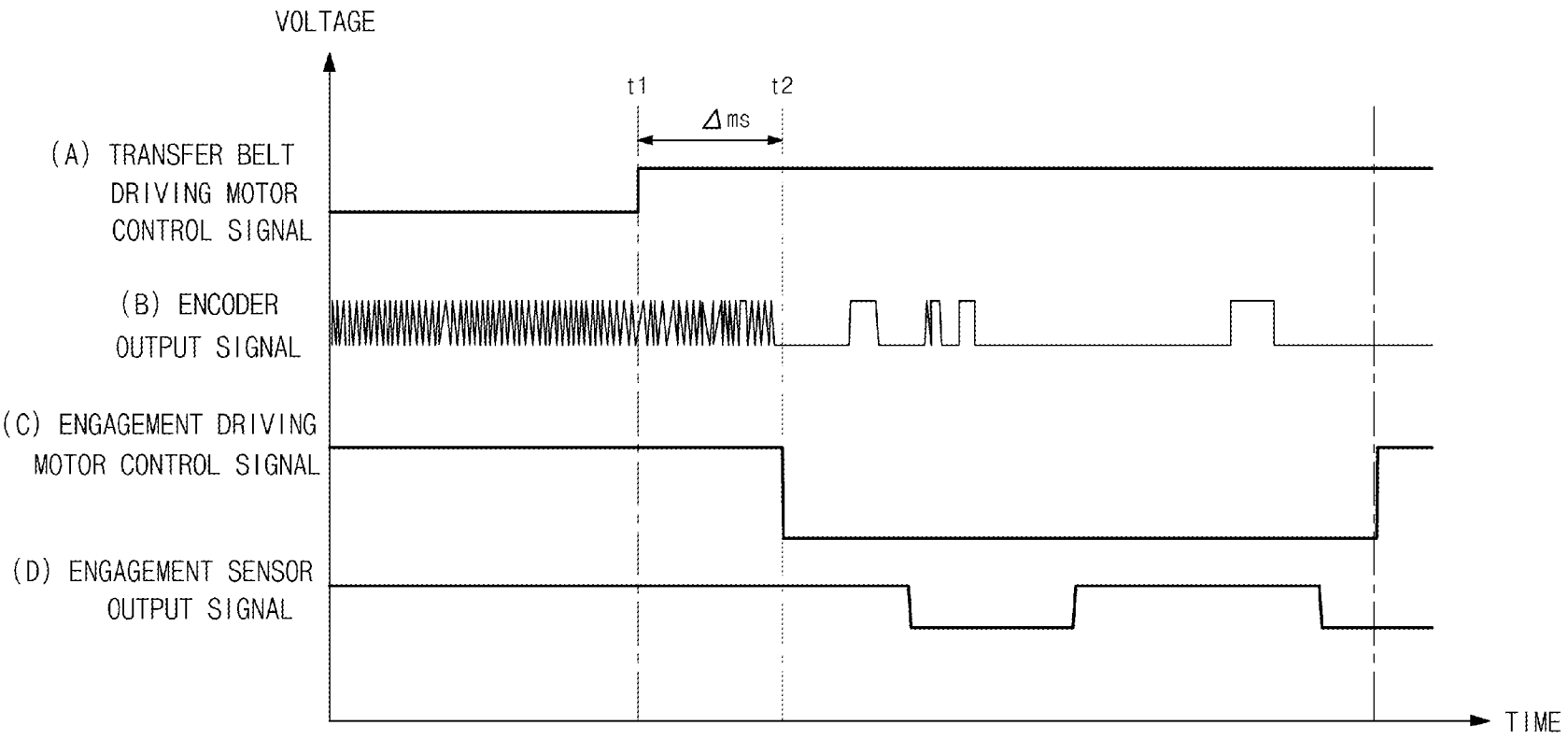
FIG. 5 is a graph illustrating waveforms (A) through (D) of the image forming apparatus in accordance with an embodiment.

FIG. 5 is a graph illustrating waveforms of the image forming apparatus in accordance with an embodiment. In FIG. 5, (A) is a transfer belt driving motor control signal to control the transfer belt driving motor 206. In FIG. 5, (B) is an encoder output signal representing rotating state information (speed and rate of rotation, etc.) of the transfer belt driving motor 206. In FIG. 5, (C) is an engagement driving motor control signal to change the positions of the transfer rollers 54 to control switching between the engagement state and the disengagement state. In FIG. 5, (D) is an engagement sensor output signal representing engagement state information of the transfer rollers 54.

As exemplarily shown in FIG. 5, in order to stop rotation of the transfer roller 54 corresponding to black, currently performing image forming in the mono mode, the controller 202 deactivates the transfer belt driving motor control signal (t1). The reason why rotation of the transfer roller 54 corresponding to black is stopped at the point of time (t1) is to switch from the mono mode to the color mode. As the transfer belt driving motor control signal is deactivated, rotation of the transfer belt 51 is stopped. At this time, the transfer belt driving motor 206 is not immediately stopped at the point of time (t1), but continues to rotate for a designated time due to rotational inertia and is then stopped. From the encoder output signal (B) in FIG. 5, it may be understood that the transfer belt driving motor 206 is rotated for a designated time (Δms) after the point of time (t1). Upon judging that rotation of the transfer belt driving motor 206 by rotational inertia is completely stopped, the controller 202 switches three transfer rollers 54 and three photoconductors 31 corresponding to cyan (C), magenta (M), and yellow (Y) to form a color image into the engagement state by activating the engagement driving control signal (t2). At the point of time (t2), since rotation of the transfer belt driving motor 206 is completely stopped, although three transfer rollers 54 and three photoconductors 31 corresponding to cyan (C), magenta (M), and yellow (Y) are now switched to the engagement state, so that no problem occurs in the color mode. In order to judge that rotation of the transfer belt driving motor 206 by rotational inertia is completely stopped, the controller 202 confirms whether or not a predetermined time (Δms) after the point of time (t1) when the transfer belt driving motor control signal is deactivated has elapsed, and judges that rotation of the transfer belt driving motor 206 by rotational inertia is completely stopped if it is confirmed that the predetermined time (Δms) has elapsed. In an example, the predetermined time (Δms) is determined through the following method. That is, a time taken to completely stop the transfer belt driving motor 206 from a point of time when the stop instructions are generated is calculated in advance through experimentation, and the calculated time is set as the predetermined time (Δms) so that the controller 202 may refer to the predetermined time (Δms). Alternatively, other methods, through which the time taken to completely stop the transfer belt driving motor 206 from the point of time when the stop instructions are generated may be predicted or measured, may be used. For example, instead of setting of the predetermined time (Δms), complete stoppage of rotation of the transfer belt driving motor 206 may be actually measured from rotating state information of the transfer belt driving motor 206. When complete stoppage of rotation of the transfer belt driving motor 206 is measured, the controller 202 activates the engagement driving motor control signal so as to form the engagement state of the transfer rollers 54 to perform the color mode.

Figure 6:
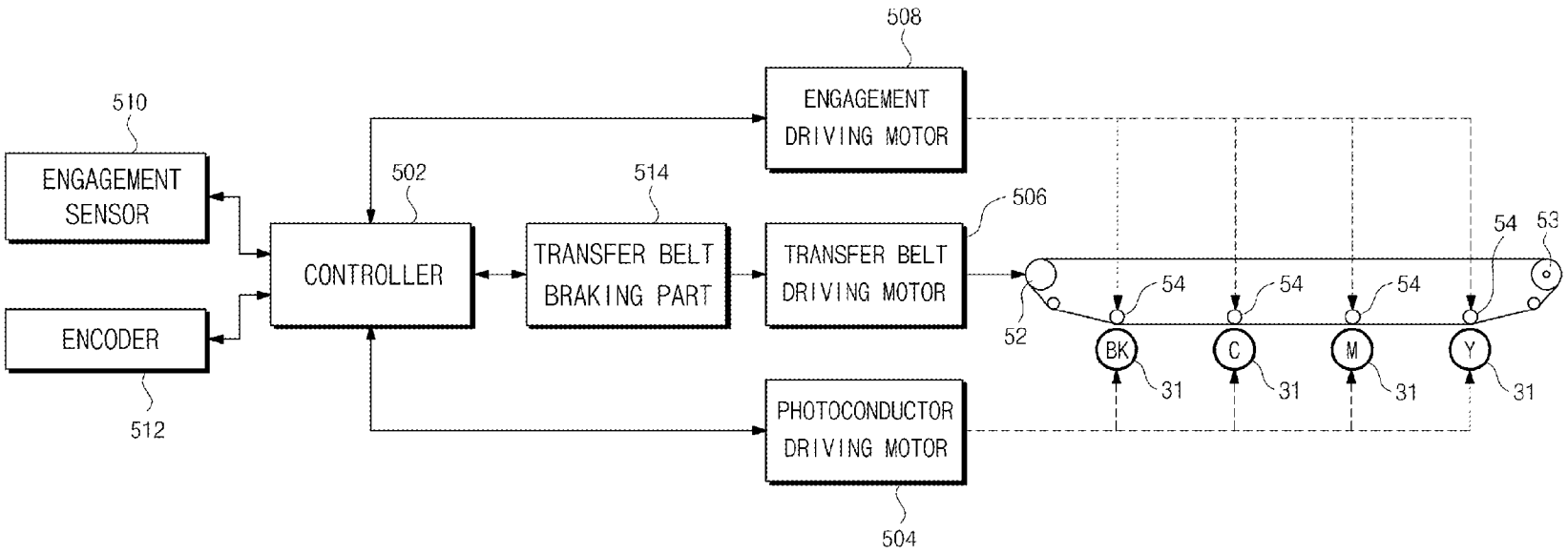
FIG. 6 is a view illustrating a control system of an image forming apparatus in accordance with an embodiment.

FIG. 6 is a view illustrating a control system of an image forming apparatus in accordance with an embodiment. As exemplarily shown in FIG. 6, a controller 502 controlling the overall operation of an image forming apparatus 100 is electrically connected to a photoconductor driving motor 504, a transfer belt driving motor 506, and an engagement driving motor 508 so as to be communicable with the photoconductor driving motor 504, the transfer belt driving motor 506, and the engagement driving motor 508. The controller 502 participates in rotation and stoppage of the photoconductors 31 through control of the photoconductor driving motor 504. Further, the controller 502 participates in rotation and stoppage of the driving roller 52 and the transfer belt 51 through control of the transfer belt driving motor 506. Further, the controller 502 participates in engagement and disengagement of the transfer rollers 54 through control of the engagement driving motor 508. In an embodiment, 'engagement' refers to a state in which the transfer roller 54 presses the transfer belt 51 and thus the transfer belt 51 contacts the photoconductor 31, and 'disengagement' refers to a state in which pressing of the transfer belt 51 by the transfer roller 54 is released and thus contact between the transfer belt 51 and the photoconductor 31 is released (with reference to FIGS. 3(A) to 3(C)). All the four transfer rollers 54 and all the four photoconductors 31 may be engaged with or disengaged from each other, or some of the four transfer rollers 54 and some of the four photoconductors 31 may be engaged with or disengaged from each other. Further, the controller 502 is electrically connected to an engagement sensor 510 and an encoder 512 so as to be communicable with the engagement sensor 510 and the encoder 512. The engagement sensor 510 serves to detect the engagement states and disengagement states among the transfer rollers 54 and the transfer belt 51 and photoconductors 31, detects the engagement states and disengagement states of the transfer rollers 54, and provides the detected state information to the controller 502. The encoder 512 is an encoder of the transfer belt driving motor 506, detects the rotating state of the transfer belt driving motor 506, and provides the rotating state information to the controller 502. A transfer belt braking part 514 is provided in the transfer belt driving motor 506. The transfer belt braking part 514 generates braking force of the transfer belt driving motor 506 when the transfer belt driving motor 506 is stopped, and thus shortens a time taken to eliminate rotational inertia so that the transfer belt driving motor 506 may be stopped more quickly (in a shorter time). The transfer belt braking part 514 may be configured to apply braking force directly to the driving roller 52 rotating the transfer belt 51, instead of applying braking force to the transfer belt driving motor 506. The controller 502 may greatly shorten a time taken to completely stop rotation of the transfer belt driving motor 506 in the rotating state by applying braking force to the transfer belt driving motor 506 through the transfer belt braking part 514 when the transfer belt driving motor 506 is stopped. When stop instructions are generated, power supply to the transfer belt driving motor 506 is interrupted and the transfer belt driving motor 506 is rotated due to rotational inertia. At this time, the rotating time of the transfer belt driving motor 506 due to rotational inertia may be greatly reduced by generating frictional force at the rotary axis of transfer belt driving motor 506. Otherwise, the rotating time of the transfer belt driving motor 506 due to rotational inertia may be greatly reduced by supplying a small amount of power in the reverse direction to the transfer belt driving motor 506.

Figure 7:
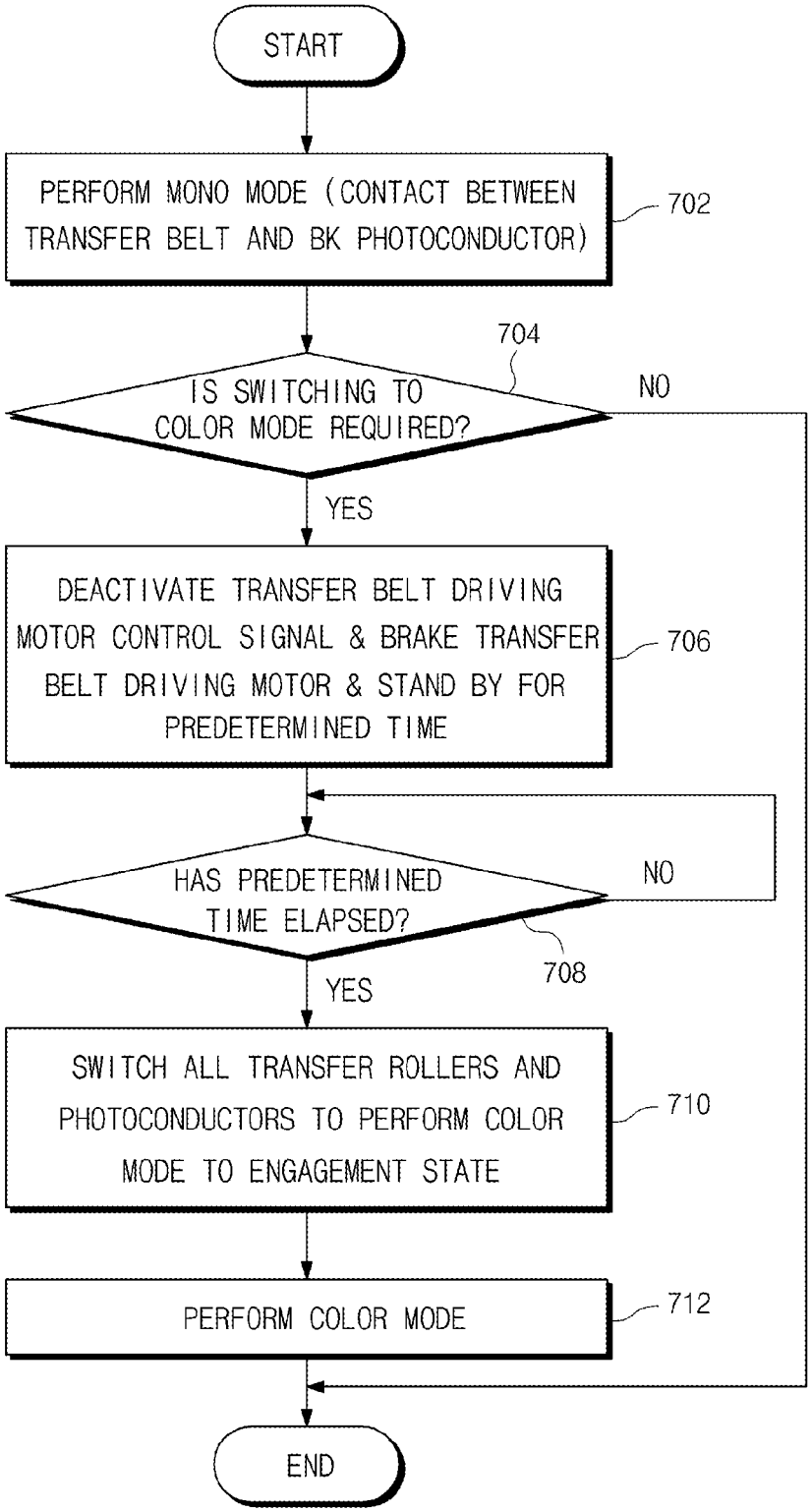
FIG. 7 is a flowchart of a control method of the image forming apparatus in accordance with an embodiment.

FIG. 7 is a flowchart of a control method of the image forming apparatus in accordance with an embodiment. As exemplarily shown in FIG. 7, in order to perform image formation in the mono mode, the controller 502 executes contact between the transfer belt 51 and the BK photoconductor 31 by pressing the transfer belt 51 using the transfer roller 54 corresponding to black (BK) (Operation 702). In such a state, the controller 502 confirms whether or not switching from the mono mode to the color mode is required (Operation 704). In an example, switching to the color mode may be executed to perform image formation in the color mode, or be executed to go through the color mode for switching to the ready mode. In order to switch from the mono mode to the color mode, the controller 502 deactivates a transfer belt driving motor control signal so as to stop rotation of the transfer belt driving motor 506, performs braking of the transfer belt driving motor 506 to shorten a time taken to stop rotation of the transfer belt driving motor 506, and stands by for a predetermined time until rotation of the transfer belt driving motor 506 is decelerated within a short time by braking (Operation 706). As the transfer belt driving motor control signal is deactivated, rotation of the transfer belt 51 is stopped. At this time, the transfer belt driving motor 506 is not immediately stopped, but continues to rotate for a designated time due to rotational inertia and is then stopped. Therefore, the controller 502 stands by for the predetermined time (Δms) until rotational inertia of the transfer belt driving motor 506 is completely eliminated ('No' in Operation 708). When the predetermined time (Δms) has elapsed ('Yes' in Operation 708)), the controller 502 switches three transfer rollers 54 and three photoconductors 31 corresponding to cyan (C), magenta (M), and yellow (Y) to form a color image to the engagement state by activating the engagement driving control signal (Operation 710). At this time, since rotation of the transfer belt driving motor 506 is completely stopped, although three transfer rollers 54 and three photoconductors 31 corresponding to cyan (C), magenta (M), and yellow (Y) are switched to the engagement state, no problem occurs. In an example, the predetermined time (Δms) is determined through the following method. That is, a time taken to completely stop the transfer belt driving motor 206 from a point of time when the stop instructions are generated is calculated in advance through experimentation, and the calculated time is set as the predetermined time (Δms) so that the controller 502 may refer to the predetermined time (Δms). Of course, other methods, through which the time taken to completely stop the transfer belt driving motor 506 from the point of time when the stop instructions are generated may be predicted or measured, may be used. For example, instead of setting of the predetermined time (Δms), complete stoppage of rotation of the transfer belt driving motor 506 may be actually measured from rotating state information of the transfer belt driving motor 506. When complete stoppage of rotation of the transfer belt driving motor 506 is measured, the controller 502 activates the engagement driving motor control signal so that the transfer rollers 54 press the transfer belt 51 and thus the engagement state in which the transfer belt 51 contacts all the photoconductors 31 is formed so as to perform image formation in the color mode (Operation 712).

Through the control method of the image forming apparatus in accordance with an embodiment shown in FIG. 7, although the transfer rollers 54 in the disengagement state are switched to the engagement state under the condition that the transfer belt 51 contacts the photoconductors 31, triboelectrification between the transfer belt 51 and the photoconductors 31 does not occur, and consequently, a band-shaped image is not formed.

Figure 8:
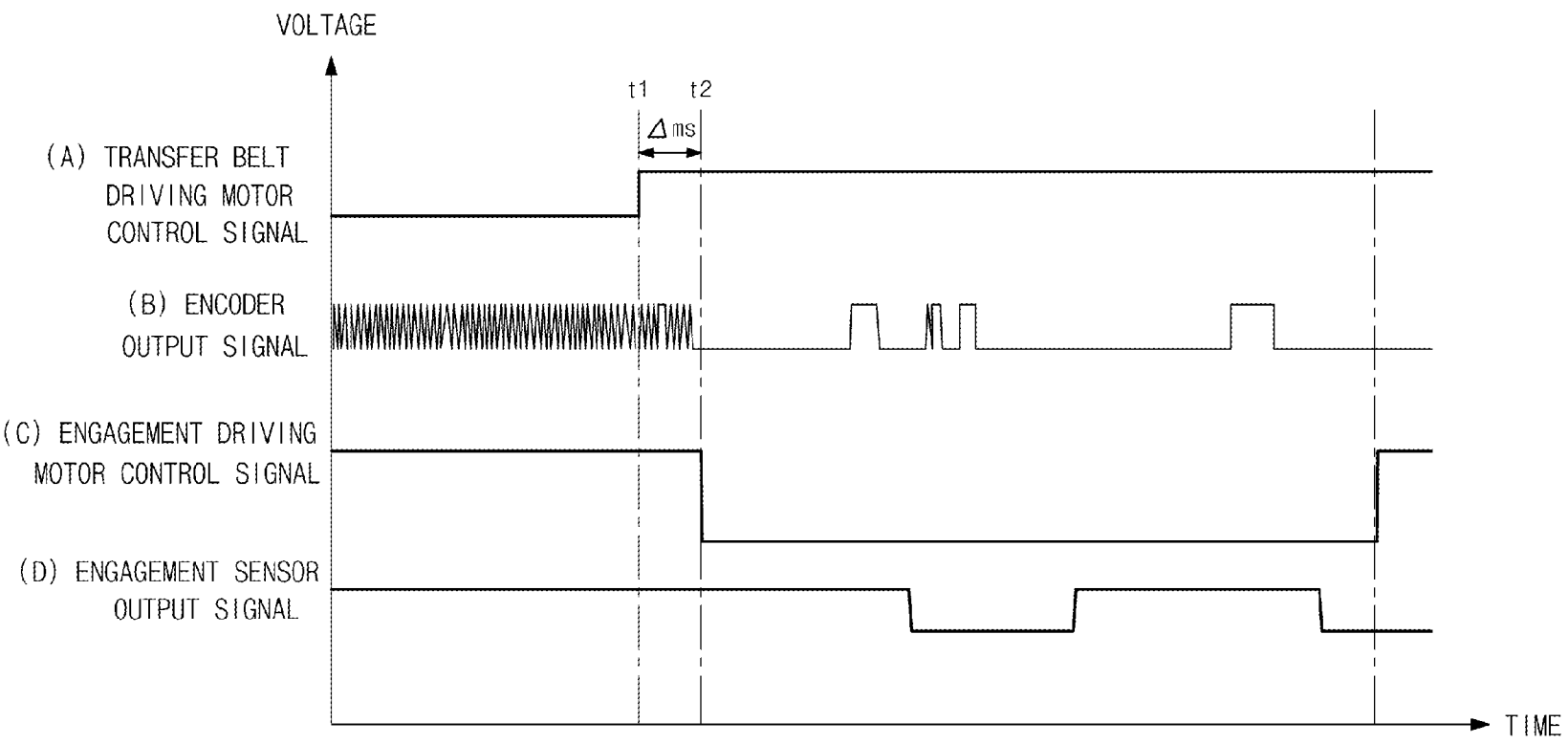
FIG. 8 is a graph illustrating waveforms (A) through (D) of the image forming apparatus in accordance with an embodiment.

FIG. 8 is a graph illustrating waveforms of the image forming apparatus in accordance with an embodiment. In FIG. 8, (A) is a transfer belt driving motor control signal to control the transfer belt driving motor 506. In FIG. 8, (B) is an encoder output signal representing rotating state information (speed and rate of rotation, etc.) of the transfer belt driving motor 506. In FIG. 8, (C) is an engagement driving motor control signal to change the positions of the transfer rollers 54 to control switching between the engagement state and the disengagement state. In FIG. 8, (D) is an engagement sensor output signal representing engagement state information of the transfer rollers 54.

As exemplarily shown in FIG. 8, in order to stop rotation of the transfer roller 54 corresponding to black, currently performing image forming in the mono mode, the controller 502 deactivates the transfer belt driving motor control signal (t1). The reason why rotation of the transfer roller 54 corresponding to black is stopped at the point of time (t1) is to switch from the mono mode to the color mode. As the transfer belt driving motor control signal is deactivated, rotation of the transfer belt 51 is stopped. At this time, the transfer belt driving motor 506 is not immediately stopped at the point of time (t1), but continues to rotate for a designated time due to rotational inertia and is then stopped. From the encoder output signal (B) in FIG. 8, it may be understood that the transfer belt driving motor 506 is rotated for a designated time (Δms) after the point of time (t1). Upon judging that rotation of the transfer belt driving motor 506 by rotational inertia is completely stopped, the controller 502 switches three transfer rollers 54 and three photoconductors 31 corresponding to cyan (C), magenta (M), and yellow (Y) to form a color image to the engagement state by activating the engagement driving control signal at a point of time (t2). At the point of time (t2), since rotation of the transfer belt driving motor 506 is completely stopped, three transfer rollers 54 and three photoconductors 31 corresponding to cyan (C), magenta (M), and yellow (Y) are switched to the engagement state, so that no problem occurs in the color mode. In order to judge that rotation of the transfer belt driving motor 506 by rotational inertia is completely stopped, the controller 502 confirms whether or not a predetermined time (Δms) after the point of time (t1) when the transfer belt driving motor control signal is deactivated has elapsed, and judges that rotation of the transfer belt driving motor 506 by rotational inertia is completely stopped if it is confirmed that the predetermined time (Δms)

has elapsed. In an example, the predetermined time (Δms) is determined through the following method. That is, a time taken to completely stop the transfer belt driving motor 506 from a point of time when the stop instructions are generated is calculated in advance through experimentation, and the calculated time is set as the predetermined time (Δms) so that the controller 502 may refer to the predetermined time (Δms). Alternatively, other methods, through which the time taken to completely stop the transfer belt driving motor 506 from the point of time when the stop instructions are generated may be predicted or measured, may be used. For example, instead of setting of the predetermined time (Δms), complete stoppage of rotation of the transfer belt driving motor 506 may be actually measured from rotating state information of the transfer belt driving motor 506. When complete stoppage of rotation of the transfer belt driving motor 506 is measured, the controller 502 activates the engagement driving motor control signal so as to form the engagement state of the transfer rollers 54 to perform the color mode.

It may be understood that the time (t2-t1) taken to judge that rotation of the transfer belt driving motor 206 is completely stopped (t2) from the point of time (t1) when the stop instructions are generated, in FIG. 8 is shorter than the time (t2-t1) in FIG. 5. The reason for this is that the transfer belt driving motor 506 or the driving roller 502 in the rotating state may more quickly reach the stoppage state by the braking action of the transfer belt braking part 514 in the control system of the image forming apparatus in accordance with an embodiment shown in FIG. 7.

Through the control method of the image forming apparatus in accordance with an embodiment shown in FIG. 8, although the transfer rollers 54 in the disengagement state are switched to the engagement state under the condition that the transfer belt 51 contacts the photoconductors 31, triboelectrification between the transfer belt 51 and the photoconductors 31 does not occur, and consequently, a band-shaped image is not formed.

Figure 9:
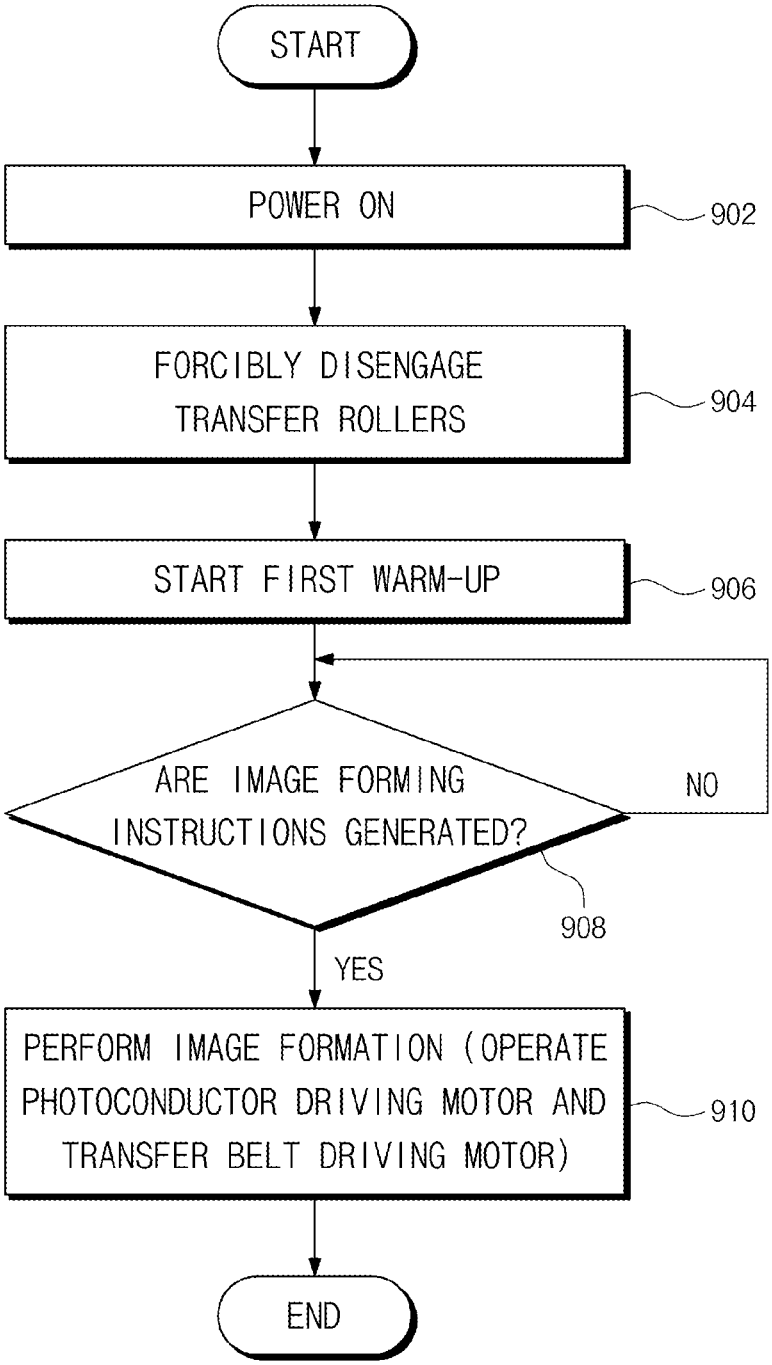
FIG. 9 is a flowchart of a control method of an image forming apparatus in accordance with an embodiment.

FIG. 9 is a flowchart of a control method of an image forming apparatus in accordance with an embodiment. The control method shown in FIG. 9 serves to prevent generation of unexpected operation under the contact state between the transfer belt 51 and the photoconductors 31 when the precise engage/disengagement state of the transfer rollers 54 prior to being powered on of the image forming apparatus is not confirmed, if the image forming apparatus is first preheated so as to perform image formation after being powered on.

As exemplarily shown in FIG. 9, when the image forming apparatus is powered on through manipulation of a power button by a user, power is supplied to respective parts of the image forming apparatus through a power supply device (Operation 902). Before first warm-up after being powered on is performed, the transfer rollers 54 are forcibly disengaged (Operation 904). The reason why the transfer rollers 54 are forcibly disengaged before first warm-up after being powered on is performed is that whether or not the current transfer roller 54 is in the engagement state or the disengagement state is not confirmed at a point of time just after being powered on. When the image forming apparatus is abnormally powered off due to interruption of power supply, caused by power failure during image formation, before being powered on of the image forming apparatus, power supply is resumed under the engagement state or disengagement state of the transfer rollers 54 when the image forming apparatus is powered on, and thus, the current state of the transfer rollers 54 is not correctly confirmed.

If the transfer rollers 54 are in the disengagement state after being powered on, no problem occurs. However, if the transfer rollers 54 are in the engagement state after being powered on, driving of the transfer belt 51 and the photoconductors 31 in the engagement state of the transfer rollers 54 may cause an unintended result. For example, if relative speeds of the transfer belt 51 and the photoconductors 31 are different (case 1), if only the transfer belt 51 is rotated under the condition that rotation of the photoconductors 31 is stopped (case 2), and if the photoconductors 31 and the transfer belt 51 are rotated in opposite directions (case 3), when the transfer rollers 54 are in the engagement state, the image forming apparatus may be damaged or an undesired image may be formed due to friction between the transfer belt 51 and the photoconductors 31.

Therefore, through the control method in accordance with an embodiment shown in FIG. 9, if the transfer rollers 54 are forcibly disengaged before first warm-up after being powered on is started, although warm-up is performed, the image forming apparatus may cope with various unpredictable situations including the cases 1 to 3 and thus perform stable image formation.

After forcible disengagement of the transfer rollers 54 has been completed, power is supplied and warm-up to preheat devices (for example, the heating roller 71 of the fixing unit 70, etc), requiring a relatively high temperature from among the elements of the image forming apparatus, to a designated temperature is performed (Operation 906). When image forming instructions are supplied after warm-up has been completed ('Yes' in Operation 908), image formation corresponding to the image forming instructions is performed (Operation 910). When image forming instructions are not supplied ('No' in Operation 908), the image forming apparatus stands by in the forcible disengagement state of the transfer rollers 54.

Figure 10:
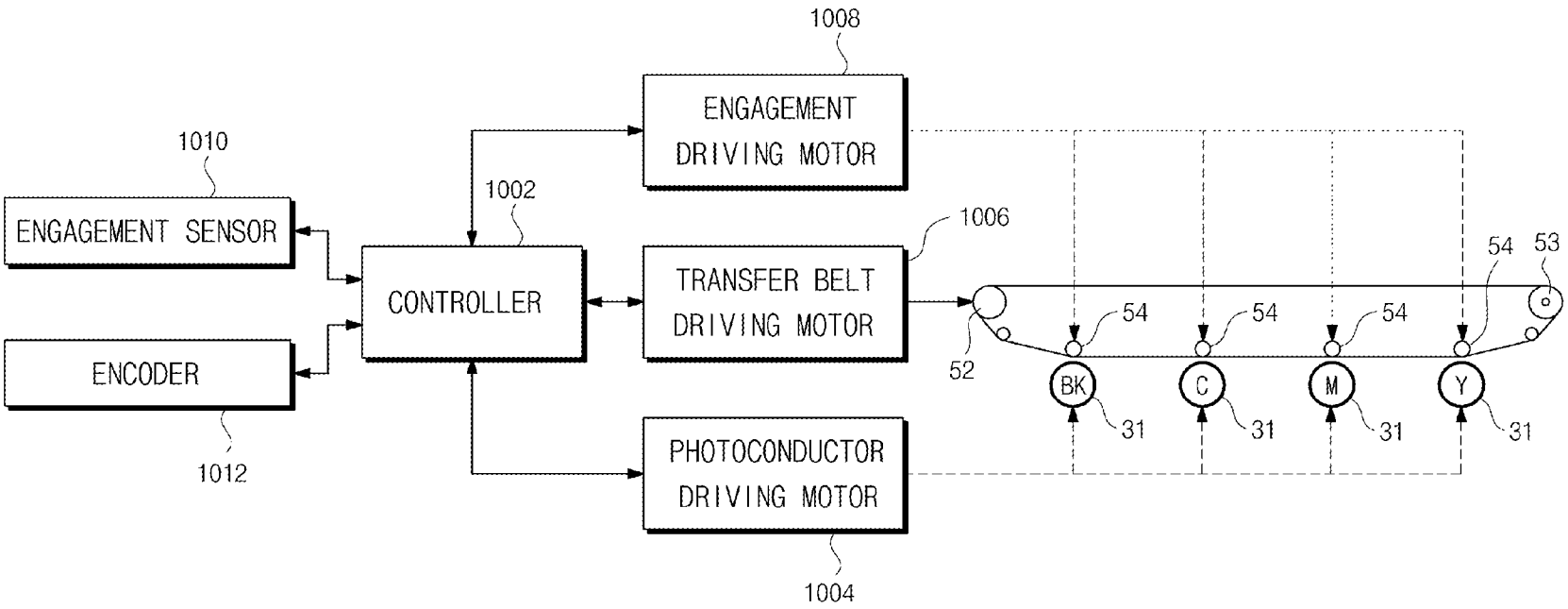
FIG. 10 is a view illustrating a control system of an image forming apparatus in accordance with an embodiment.

FIG. 10 is a view illustrating a control system of an image forming apparatus in accordance with an embodiment. As exemplarily shown in FIG. 10, a controller 1002 controlling the overall operation of an image forming apparatus 100 is electrically connected to a photoconductor driving motor 1004, a transfer belt driving motor 1006, and an engagement driving motor 1008 so as to be communicable with the photoconductor driving motor 1004, the transfer belt driving motor 1006, and the engagement driving motor 1008. The controller 1002 participates in rotation and stoppage of the photoconductors 31 through control of the photoconductor driving motor 1004. Further, the controller 1002 participates in rotation and stoppage of the driving roller 52 and the transfer belt 51 through control of the transfer belt driving motor 1006. Further, the controller 1002 participates in engagement and disengagement of the transfer rollers 54 through control of the engagement driving motor 1008. In an example, 'engagement' refers to a state in which the transfer roller 54 presses the transfer belt 51 and thus the transfer belt 51 contacts the photoconductor 31, and 'disengagement' refers to a state in which pressing of the transfer belt 51 by the transfer roller 54 is released and thus contact between the transfer belt 51 and the photoconductor 31 is released (with reference to FIGS. 11(A) and 11(B)).

All the four transfer rollers 54 and all the four photoconductors 31 may be engaged with or disengaged from each other, or some of the four transfer rollers 54 and some of the four photoconductors 31 may be engaged with or disengaged from each other. Further, the controller 1002 is electrically connected to an engagement sensor 1010 and an encoder 1012 so as to be communicable with the engagement sensor 1010 and the encoder 1012. The engagement sensor 1010 serves to detect the engagement states and disengagement states among the transfer rollers 54 and the transfer belt 51 and photoconductors 31, detects the engagement states and disengagement states of the transfer rollers 54, and provides the detected state information to the controller 1002. The encoder 1012 is an encoder of the transfer belt driving motor 1006, detects the rotating state of the transfer belt driving motor 1006, and provides the rotating state information to the controller 1002.

Figure 11:
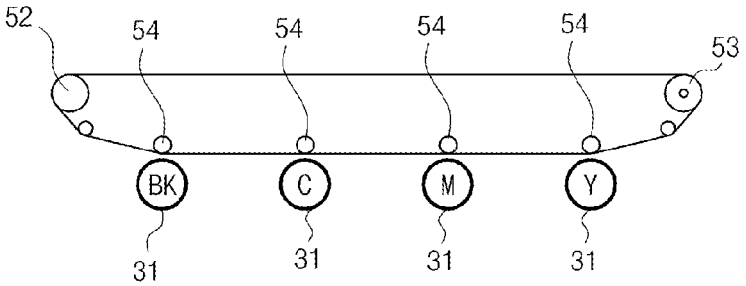
FIG. 11, (A) and (B), are views illustrating operating modes regarding a transfer device and photoconductors of the image forming apparatus shown in FIG. 10.
Figure 11:
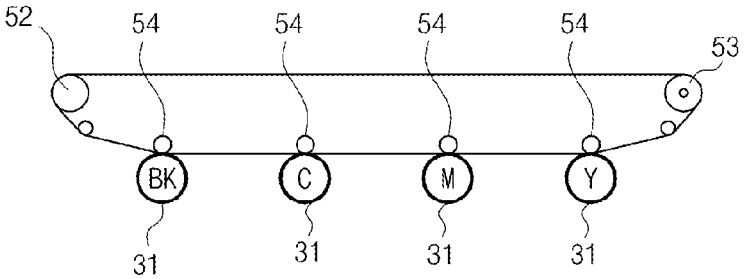

FIGS. 11(A) and 11(B) are views illustrating operating modes regarding a transfer device and the photoconductors of the image forming apparatus shown in FIG. 10. First, FIG. 11(A) illustrates a ready mode prior to image formation. In the ready mode, all the transfer rollers 54, the transfer belt 51, and all the opposite photoconductors 31 are disengaged from one another. In an example, opposite refers to the four transfer rollers 54 and the four photoconductors 31 corresponding to each other. In the ready mode, image formation is not carried out, and thus, the disengagement state between the all the transfer rollers 54 and the all the photoconductors 31 is maintained.

FIG. 11(B) illustrates a color mode in which a color image is formed using black (BK), cyan (C), magenta (M), and yellow (Y) developing agents. In the color mode, all the four transfer rollers 54, the transfer belt 51, and all the four photoconductors 31 corresponding to black (BK), cyan (C), magenta (M), and yellow (Y) are engaged with one another. In the color mode, since black (BK), cyan (C), magenta (M), and yellow (Y) participate in image formation, all the four transfer rollers 54 and all the four photoconductors 31 are rotated.

In the image forming apparatus 100 in accordance with an embodiment, the ready mode and the color mode may be switched in the order of ' . . . →ready mode→color mode→ready mode→color mode→ . . . '.

If the ready mode is switched to the color mode, the disengagement state between all the transfer rollers 54 and all the photoconductors 31, as exemplarily shown in FIG. 11(A), is switched to the engagement state between the four transfer rollers 54 and the four photoconductors 31 corresponding to black (BK), cyan (C), magenta (M), and yellow (Y) to form a color image, as exemplarily shown in FIG. 11(B). When the state of FIG. 11(A) is switched to the state of FIG. 11(B), after stop instructions of the transfer belt driving motor 1006 driven to rotate the transfer belt 51 are generated and applied to the transfer belt driving motor 1006 to stop the transfer belt driving motor 1006, engagement among the four transfer rollers 54, the transfer belt 51, and the four photoconductors 31 corresponding to black (BK), cyan (C), magenta (M), and yellow (Y) is carried out.

If, although the stop instructions are applied to the transfer belt driving motor 1006, the transfer rollers 54 are switched to the engagement state under the condition that the transfer belt driving motor 1006 is not immediately stopped but is rotated for a designated time due to rotational inertia, a band-shaped image may be formed on the transfer rollers 54 due to contact between the transfer belt 51 rotated by rotational inertia of the transfer belt driving motor 1006 and the transfer rollers 54 engaged therewith, and such an image may have an unintended influence on an image on a printing medium. In the image forming apparatus in accordance with an embodiment, in order to prevent such a problem, additional switching to the engagement states of the transfer rollers 54 is not executed for a predetermined time (Δms) so that rotational inertia of the transfer belt driving motor 1006 completely disappears and the transfer belt driving motor 1006 is completely stopped during mode switching, and the engagement driving motor 1008 is operated after the predetermined (Δms) has elapsed so that the transfer rollers 54, the transfer belt 51 and the photoconductors 31 are engaged with each other.

Figure 12:
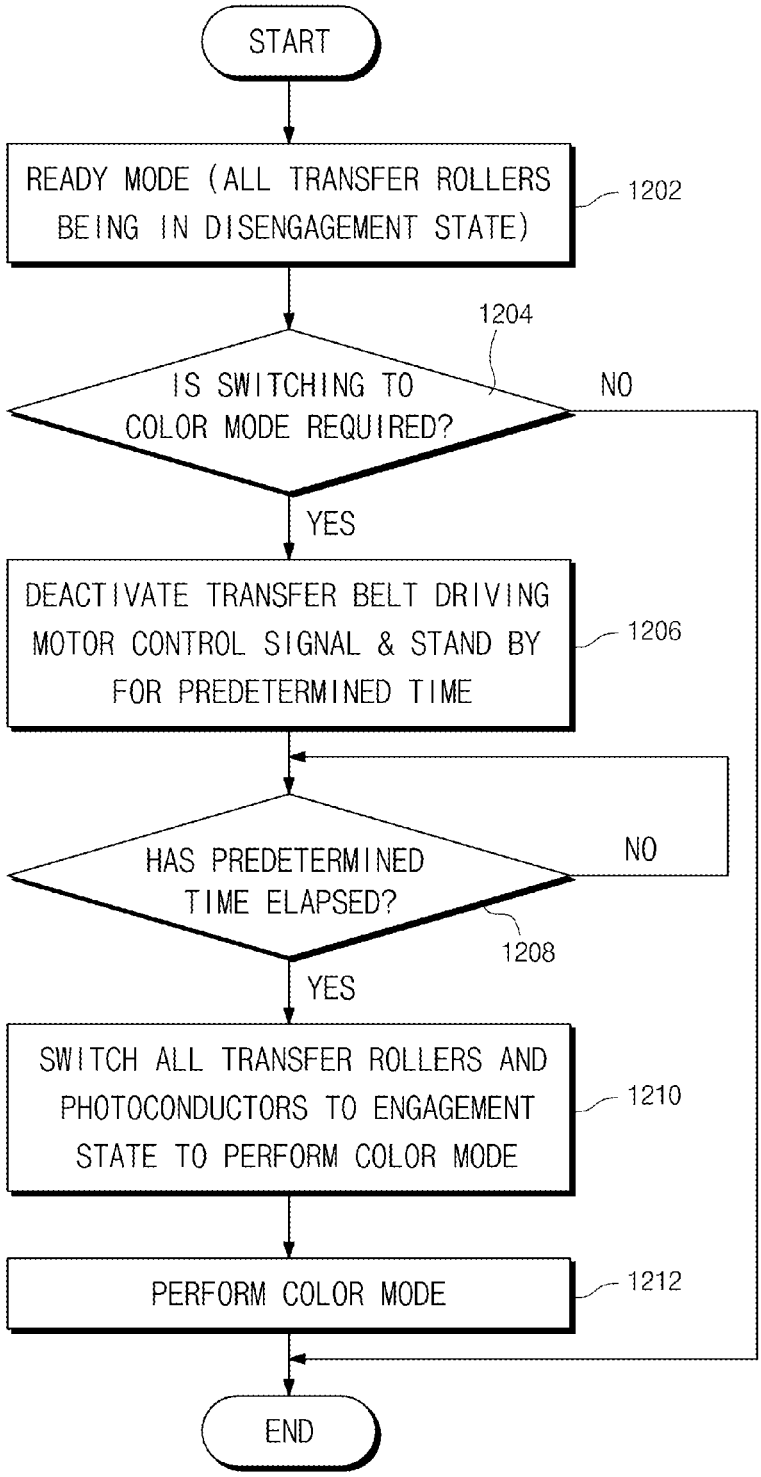
FIG. 12 is a flowchart of a control method of the image forming apparatus in accordance with an embodiment.

FIG. 12 is a flowchart of a control method of the image forming apparatus in accordance with an embodiment. As exemplarily shown in FIG. 12, in order to perform the ready mode, the controller 1002 switches all the transfer rollers 54 to the disengagement state (Operation 1202). In such a state, the controller 1002 confirms whether or not switching from the ready mode to the color mode is required (Operation 1204). In an example, switching to the color mode may be executed to perform image formation in the color mode. In order to switch from the ready mode to the color mode, the controller 1002 deactivates a transfer belt driving motor control signal so as to stop rotation of the transfer belt driving motor 1006, and, for this purpose, stands by for a predetermined time (Operation 1206). As the transfer belt driving motor control signal is deactivated, rotation of the transfer belt 51 is stopped. At this time, the transfer belt driving motor 1006 is not immediately stopped, but continues to rotate for a designated time due to rotational inertia and is then stopped. Therefore, the controller 1002 stands by for the predetermined time (Δms) until rotational inertia of the transfer belt driving motor 1006 is completely eliminated ('No' in Operation 1208). When the predetermined time (Δms) has elapsed ('Yes' in Operation 1208), the controller 1002 switches four transfer rollers 54 and four photoconductors 31 corresponding to black (BK), cyan (C), magenta (M), and yellow (Y) to form a color image to the engagement state by activating the engagement driving control signal (Operation 1210). At this time, since rotation of the transfer belt driving motor 1006 is completely stopped, although four transfer rollers 54 and four photoconductors 31 corresponding to black (BK), cyan (C), magenta (M), and yellow (Y) are switched to the engagement state, no problem occurs.

In an example, the predetermined time (Δms) is determined through the following method. That is, a time taken to completely stop the transfer belt driving motor 1006 from a point of time when the stop instructions are generated is calculated in advance through experimentation, and the calculated time is set as the predetermined time (Δms) so that the controller 1002 may refer to the predetermined time (Δms). Of course, other methods, through which the time taken to completely stop the transfer belt driving motor 1006 from the point of time when the stop instructions are generated may be predicted or measured, may be used. For example, instead of setting of the predetermined time (Δms), complete stoppage of rotation of the transfer belt driving motor 1006 may be actually measured from rotating state information of the transfer belt driving motor 1006. When complete stoppage of rotation of the transfer belt driving motor 1006 is measured, the controller 1002 activates the engagement driving motor control signal so that the transfer rollers 54 press the transfer belt 51 and thus the engagement state in which the transfer belt 51 contacts all the photoconductors 31 is formed so as to perform image formation in the color mode (Operation 1212).

Through the control method of the image forming apparatus in accordance with an embodiment shown in FIG. 12, although the transfer rollers 54 in the disengagement state are switched to the engagement state under the condition that the transfer belt 51 contacts the photoconductors 31, triboelectrification between the transfer belt 51 and the photoconductors 31 does not occur, and consequently, a band-shaped image is not formed.

Figure 13:
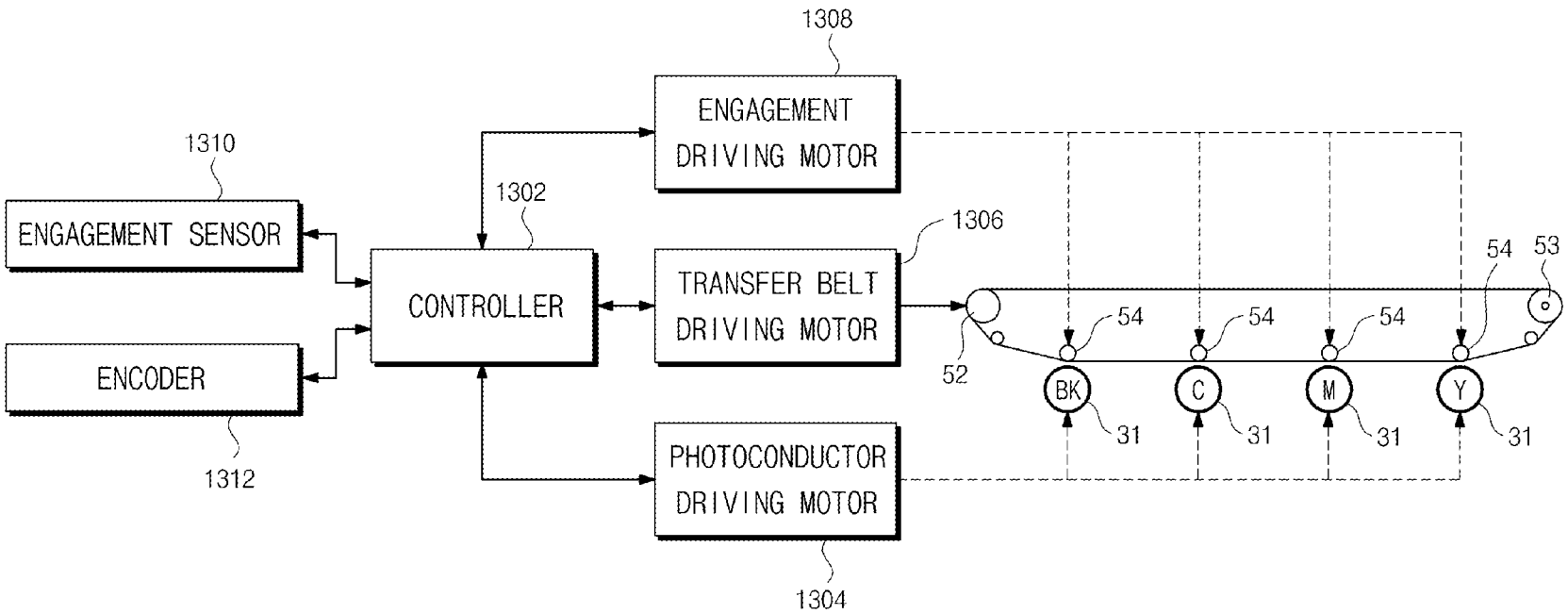
FIG. 13 is a view illustrating a control system of an image forming apparatus in accordance with an embodiment.

FIG. 13 is a view illustrating a control system of an image forming apparatus in accordance with an embodiment. As exemplarily shown in FIG. 13, a controller 1302 controlling the overall operation of an image forming apparatus 100 is electrically connected to a photoconductor driving motor 1304, a transfer belt driving motor 1306, and an engagement driving motor 1308 so as to be communicable with the photoconductor driving motor 1304, the transfer belt driving motor 1306, and the engagement driving motor 1308. The controller 1302 participates in rotation and stoppage of the photoconductors 31 through control of the photoconductor driving motor 1304. Further, the controller 1302 participates in rotation and stoppage of the driving roller 52 and the transfer belt 51 through control of the transfer belt driving motor 1306. Further, the controller 1302 participates in engagement and disengagement of the transfer rollers 54 through control of the engagement driving motor 1308. In an example, 'engagement' refers to a state in which the transfer roller 54 presses the transfer belt 51 and thus the transfer belt 51 contacts the photoconductor 31, and 'disengagement' refers to a state in which pressing of the transfer belt 51 by the transfer roller 54 is released and thus contact between the transfer belt 51 and the photoconductor 31 is released (with reference to FIGS. 14(A) and 14(B)). All the four transfer rollers 54 and all the four photoconductors 31 may be engaged with or disengaged from each other, or some of the four transfer rollers 54 and some of the four photoconductors 31 may be engaged with or disengaged from each other. Further, the controller 1302 is electrically connected to an engagement sensor 1310 and an encoder 1312 so as to be communicable with the engagement sensor 1310 and the encoder 1312. The engagement sensor 1310 serves to detect the engagement states and disengagement states among the transfer rollers 54 and the transfer belt 51 and photoconductors 31, detects the engagement states and disengagement states of the transfer rollers 54, and provides the detected state information to the controller 1302. The encoder 1312 is an encoder of the transfer belt driving motor 1306, detects the rotating state of the transfer belt driving motor 1306, and provides the rotating state information to the controller 1302.

Figure 14:
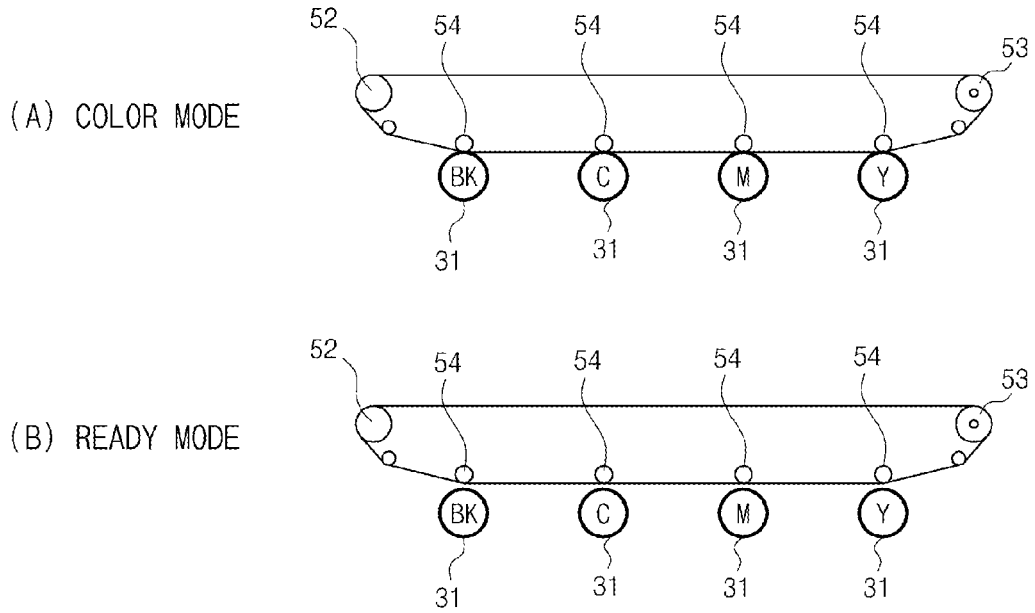
FIG. 14, (A) and (B), are views illustrating operating modes regarding a transfer device and photoconductors of the image forming apparatus shown in FIG. 13.

FIGS. 14(A) and 14(B) are views illustrating operating modes regarding a transfer device and the photoconductors of the image forming apparatus shown in FIG. 13. First, FIG. 14(A) illustrates a color mode in which a color image is formed using black (BK), cyan (C), magenta (M), and yellow (Y) developing agents. In the color mode, all the four transfer rollers 54, the transfer belt 51, and all the four photoconductors 31 corresponding to black (BK), cyan (C), magenta (M), and yellow (Y) are engaged with one another. In the color mode, since black (BK), cyan (C), magenta (M), and yellow (Y) participate in image formation, all the four transfer rollers 54 and all the four photoconductors 31 are rotated.

FIG. 14(B) illustrates a ready mode prior to image formation. In the ready mode, all the transfer rollers 54, the transfer belt 51, and all the opposite photoconductors 31 are disengaged from one another. In an example, opposite refers to the four transfer rollers 54 and the four photoconductors 31 corresponding to each other. In the ready mode, image formation is not carried out, and thus, the disengagement state between the all the transfer rollers 54 and the all the photoconductors 31 is maintained.

In the image forming apparatus 100 in accordance with an embodiment, the ready mode and the color mode may be switched in the order of '. . . →ready mode→color mode→ready mode→color mode→ . . .'.

If the color mode is switched to the ready mode, the engagement state between all the transfer rollers 54 and all the photoconductors 31, as exemplarily shown in FIG. 14(A), is switched to the disengagement state between the four transfer rollers 54 and the four photoconductors 31 corresponding to black (BK), cyan (C), magenta (M), and yellow (Y) to form a color image, as exemplarily shown in FIG. 14(B). When the state of FIG. 14(A) is switched to the state of FIG. 14(B), after stop instructions of the transfer belt driving motor 1306 driven to rotate the transfer belt 51 are generated and applied to the transfer belt driving motor 1306 to stop the transfer belt driving motor 1306, disengagement among the four transfer rollers 54, the transfer belt 51, and the four photoconductors 31 corresponding to black (BK), cyan (C), magenta (M), and yellow (Y) is carried out.

If, although the stop instructions are applied to the transfer belt driving motor 1306, the transfer rollers 54 are switched to the disengagement state under the condition that the transfer belt driving motor 1306 is not immediately stopped but is rotated for a designated time due to rotational inertia, a band-shaped image may be formed on the transfer rollers 54 due to triboelectrification between the transfer belt 51 and the photoconductors 31 at a point of time when contact between the transfer belt 51, rotated due to rotational inertia of the transfer belt driving motor 1306, and the transfer rollers 54 disengaged therefrom is released, and such an image may have an unintended influence on an image on a printing medium. In the image forming apparatus in accordance with an embodiment, in order to prevent such a problem, additional switching to the disengagement states of the transfer rollers 54 is not executed for a predetermined time (Δms) so that rotational inertia of the transfer belt driving motor 1306 completely disappears and the transfer belt driving motor 1306 is completely stopped during mode switching, and the engagement driving motor 1308 is operated after the predetermined (Δms) has elapsed so that the transfer rollers 54, the transfer belt 51 and the photoconductors 31 are disengaged from each other.

Figure 15:
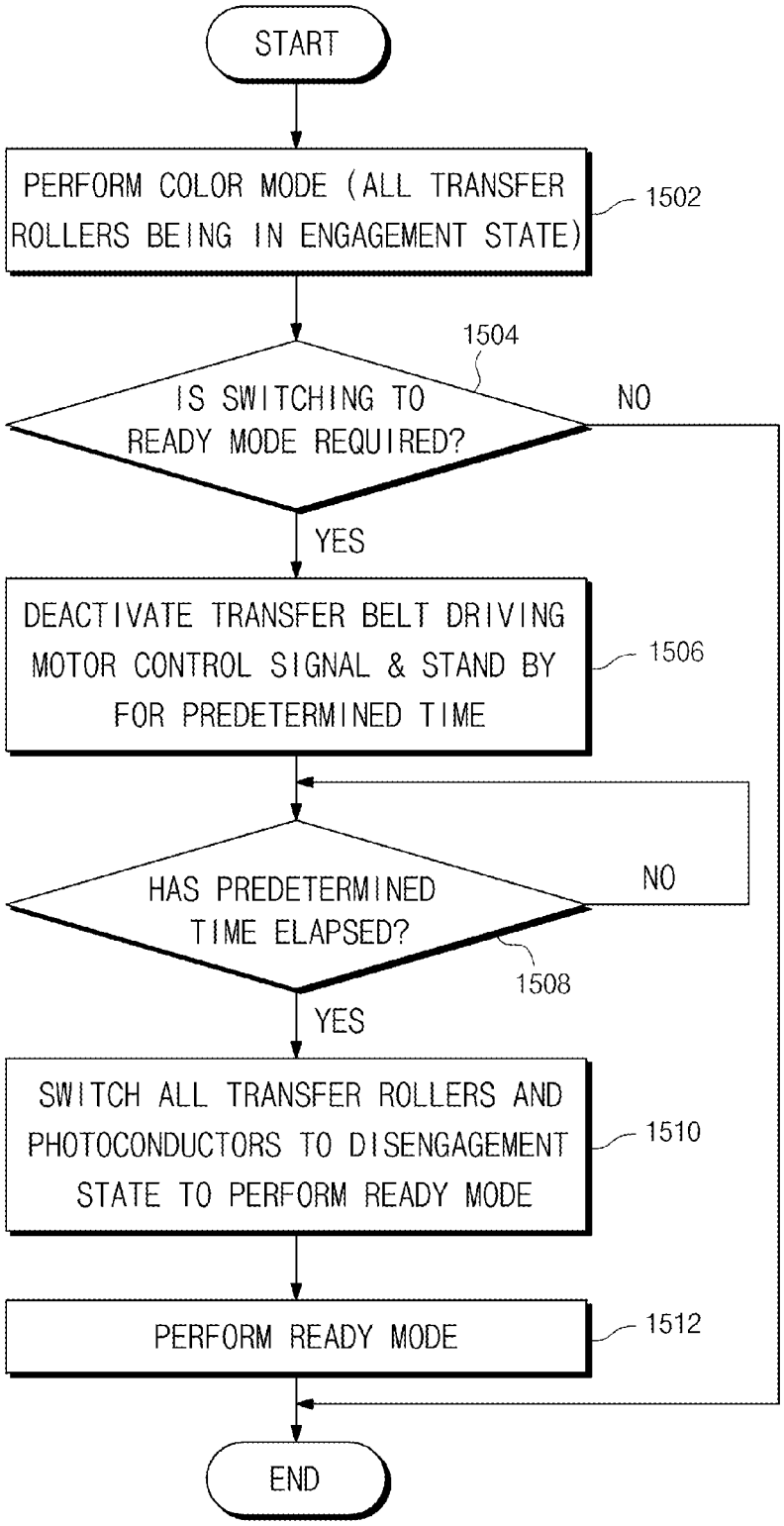
FIG. 15 is a flowchart of a control method of the image forming apparatus in accordance with an embodiment.

FIG. 15 is a flowchart of a control method of the image forming apparatus in accordance with an embodiment. As exemplarily shown in FIG. 15, in order to perform image formation in the color mode, the controller 1302 switches all the transfer rollers 54 to the engagement state (Operation 1502). In such a state, the controller 1302 confirms whether or not switching from the color mode to the ready mode is required (Operation 1504). In order to switch from the color mode to the ready mode, the controller 1302 deactivates a transfer belt driving motor control signal so as to stop rotation of the transfer belt driving motor 1306, and, for this purpose, stands by for a predetermined time (Operation 1506). As the transfer belt driving motor control signal is deactivated, rotation of the transfer belt 51 is stopped. At this time, the transfer belt driving motor 1306 is not immediately stopped, but continues to rotate for a designated time due to rotational inertia and is then stopped. Therefore, the controller 1302 stands by for the predetermined time (Δms) until rotational inertia of the transfer belt driving motor 1306 is completely eliminated ('No' in Operation 1508). When the predetermined time (Δms) has elapsed ('Yes' in Operation 1508), the controller 1302 switches four transfer rollers 54 and four photoconductors 31 corresponding to black (BK), cyan (C), magenta (M), and yellow (Y) to the disengagement state by deactivating the engagement driving control signal (Operation 1510). At this time, since rotation of the transfer belt driving motor 1306 is completely stopped, although four transfer rollers 54 and four photoconductors 31 corresponding to black (BK), cyan (C), magenta (M), and yellow (Y) are switched to the disengagement state, no problem occurs. In an example, the predetermined time (Δms) is determined through the following method. That is, a time taken to completely stop the transfer belt driving motor 1306 from a point of time when the stop instructions are generated is calculated in advance through experimentation, and the calculated time is set as the predetermined time (Δms) so that the controller 1302 may refer to the predetermined time (Δms). Of course, other methods, through which the time taken to completely stop the transfer belt driving motor 1306 from the point of time when the stop instructions are generated may be predicted or measured, may be used. For example, instead of setting of the predetermined time (Δms), complete stoppage of rotation of the transfer belt driving motor 1306 may be actually measured from rotating state information of the transfer belt driving motor 1306. When complete stoppage of rotation of the transfer belt driving motor 1306 is measured, the controller 1302 deactivates the engagement driving motor control signal so that the transfer rollers 54 press the transfer belt 51 and thus the disengagement state in which contact between the transfer belt 51 and all the photoconductors 31 by the transfer rollers 54 is released is formed so as to perform the ready mode (Operation 1512).

Through the control method of the image forming apparatus in accordance with an embodiment shown in FIG. 15, although the transfer rollers 54 in the engagement state are switched to the disengagement state under the condition that the transfer belt 51 contacts the photoconductors 31, triboelectrification between the transfer belt 51 and the photoconductors 31 does not occur, and consequently, a band-shaped image is not formed.

As is apparent from the above description, in an image forming apparatus and a control method thereof in accordance with an embodiment, transfer rollers press a transfer belt after stoppage of the transfer belt if the transfer rollers presses the transfer belt to cause the transfer belt to contact photoconductors, and thus contact between the transfer belt in the rotating state and the photoconductors may be prevented, thus preventing damage to the transfer belt, the transfer rollers, and the photoconductors and preventing contamination of a printed matter due to triboelectrification caused by contact between the transfer belt in the rotating state and the photoconductors.

Although a few embodiments of have been shown and described, it would be appreciated by those skilled in the art that changes may be made in these embodiments without departing from the principles and spirit of the disclosure, the scope of which is defined in the claims and their equivalents.

What is claimed is:

1. A control method of an image forming apparatus which has a plurality of transfer rollers, a plurality of photoconductors and a transfer belt, the transfer belt is interposed between the plurality of transfer rollers and the plurality of photoconductors and pressing the transfer belt to come into contact with the plurality of photoconductors, the control method comprising:

rotating the transfer belt under the condition that the plurality of transfer rollers does not press the transfer belt toward the plurality of photoconductors;

interrupting power transmitted to the transfer belt to cause the plurality of transfer rollers to press the transfer belt;

standing by until rotation of the transfer belt is stopped, after interruption of the power; and controlling the plurality of transfer rollers so as to press the transfer belt toward the plurality of photoconductors, when rotation of the transfer belt is stopped.

2. The control method according to claim 1, wherein the standing by is carried out for a predetermined time until rotation of the transfer belt is stopped.

3. The control method according to claim 2, wherein the predetermined time is time for which the transfer belt is rotated due to rotational inertia after interruption of the power transmitted to the transfer belt.

4. The control method according to claim 1, wherein:

in a ready mode, the pressing state of the plurality of transfer rollers is released so that all of the plurality of transfer rollers does not contact the plurality of photoconductors; and in a color mode, transfer rollers participating in formation of a color image among the plurality of transfer rollers press the transfer belt so as to contact corresponding photoconductors.

5. A control method of an image forming apparatus which has a plurality of transfer rollers, a plurality of photoconductors and a transfer belt, the transfer belt is interposed between the plurality of transfer rollers and the plurality of photoconductors and pressing the transfer belt to come into contact with the plurality of photoconductors, the control method comprising:

rotating the transfer belt under the condition that the plurality of transfer rollers presses the transfer belt toward the plurality of photoconductors;

interrupting power transmitted to the transfer belt to release the pressed state of the transfer belt by the plurality of transfer rollers;

standing by until rotation of the transfer belt is stopped, after interruption of the power; and releasing the pressed state of the transfer belt by the plurality of transfer rollers, when rotation of the transfer belt is stopped.

6. The control method according to claim 5, wherein the standing by is carried out for a predetermined time until rotation of the transfer belt is stopped.

7. The control method according to claim 6, wherein the predetermined time is time taken to stop rotation of the transfer belt due to rotational inertia after interruption of the power transmitted to the transfer belt.

8. The control method according to claim 5, wherein:

in a ready mode, the pressing state of the plurality of transfer rollers is released so that all of the plurality of transfer rollers does not contact the plurality of photoconductors; and in a color mode, transfer rollers participating in formation of a color image among the plurality of transfer rollers press the transfer belt so as to contact corresponding photoconductors.

9. A control method of an image forming apparatus which has a plurality of transfer rollers, a plurality of photoconductors and a transfer belt, the transfer belt is interposed between the plurality of transfer rollers and the plurality of photoconductors and pressing the transfer belt to come into contact with the plurality of photoconductors, the control method comprising:

rotating the transfer belt under the condition that at least one of the plurality of transfer rollers presses the transfer belt toward at least one of the plurality of photoconductors;

interrupting power transmitted to the transfer belt to cause at least another of the plurality of transfer rollers to press the transfer belt toward at least another of the plurality of photoconductors;

standing by until rotation of the transfer belt is stopped, after interruption of the power; and controlling the at least another of the plurality of transfer rollers so as to press the transfer belt toward the at least another of the plurality of photoconductors, when until rotation of the transfer belt is stopped.

10. The control method according to claim 9, wherein the standing by is carried out for a predetermined time until rotation of the transfer belt is stopped.

11. The control method according to claim 10, wherein the predetermined time is time taken to stop rotation of the transfer belt due to rotational inertia after interruption of the power transmitted to the transfer belt.

12. The control method according to claim 9, wherein:

in a ready mode, the pressing state of the plurality of transfer rollers is released so that all of the plurality of transfer rollers does not contact the plurality of photoconductors;

in a mono mode, only a transfer roller participating in formation of a mono image among the plurality of transfer rollers presses the transfer belt so as to contact a corresponding photoconductor; and in a color mode, transfer rollers participating in formation of a color image among the plurality of transfer rollers press the transfer belt so as to contact corresponding photoconductors.

13. The control method according to claim 12, wherein mode switching is carried out in the order of the ready mode, the mono mode, and the color mode.

14. An image forming apparatus comprising:

a plurality of photoconductors;

a plurality of transfer rollers;

a transfer belt which is interposed between the plurality of transfer rollers and the plurality of photoconductors and which press the transfer belt to come into contact with the plurality of photoconductors; and a controller which rotates the transfer belt under the condition that at least one of the plurality of transfer rollers presses the transfer belt toward at least one of the plurality of photoconductors, interrupts power transmitted to the transfer belt to cause at least another of the plurality of transfer rollers to press the transfer belt toward at least another of the plurality of photoconductors, stands by until rotation of the transfer belt is stopped, after interruption of the power, and controls the at least another of the plurality of transfer rollers so as to press the transfer belt toward the at least another of the plurality of photoconductors.

15. The image forming apparatus according to claim 14, wherein the controller stands by for a predetermined time until rotation of the transfer belt is stopped.

16. The image forming apparatus according to claim 15, wherein the predetermined time is time taken to stop rotation of the transfer belt due to rotational inertia after interruption of the power transmitted to the transfer belt.

17. The image forming apparatus according to claim 14, wherein:

in a ready mode, the pressing state of the plurality of transfer rollers is released so that all of the plurality of transfer rollers does not contact the plurality of photoconductors;

in a mono mode, only a transfer roller, which participates in formation of a mono image among the plurality of transfer rollers, presses the transfer belt so as to contact a corresponding photoconductor; and in a color mode, transfer rollers, which participate in formation of a color image among the plurality of transfer rollers, press the transfer belt so as to contact corresponding photoconductors.

18. The image forming apparatus according to claim 17, wherein mode switching is carried out in the order of the ready mode, the mono mode, and the color mode.

19. A control method of an image forming apparatus which has a plurality of transfer rollers, a plurality of photoconductors and a transfer belt, the transfer belt is interposed between the plurality of transfer rollers and the plurality of photoconductors and pressing the transfer belt to come into contact with the plurality of photoconductors, the control method comprising:

forcibly releasing the contact state between the transfer belt and the plurality of photoconductors by pressing the transfer belt using the plurality of transfer rollers, before first warm-up after being powered-on of the image forming apparatus is performed; and performing the first warm-up, when the contact state between the transfer belt and the plurality of photoconductors is released.

20. An image forming apparatus comprising:

a plurality of photoconductors;

a plurality of transfer rollers;

a transfer belt which is interposed between the plurality of transfer rollers and the plurality of photoconductors and which press the transfer belt to come into contact with the plurality of photoconductors; and a controller which forcibly releases the contact state between the transfer belt and the plurality of photoconductors by pressing the transfer belt through the plurality of transfer rollers, before first warm-up after being powered on of the image forming apparatus is performed.

21. The image forming apparatus according to claim 20, wherein the controller performs the first warm-up, when the contact state between the transfer belt and the plurality of photoconductors is released.

22. A control method of an image forming apparatus which has a plurality of transfer rollers, a plurality of photoconductors and a transfer belt, the transfer belt is interposed between the plurality of transfer rollers and the plurality of photoconductors and pressing the transfer belt to come into contact with the plurality of photoconductors, the control method comprising:

rotating the transfer belt under the condition that the plurality of transfer rollers does not press the transfer belt toward the plurality of photoconductors;

interrupting power transmitted to the transfer belt to cause the plurality of transfer rollers to press the transfer belt;

reducing the rotational speed of the transfer belt due to rotational inertia by controlling a transfer belt braking part;

standing by until rotation of the transfer belt is stopped; and controlling the plurality of transfer rollers so as to press the transfer belt toward the plurality of photoconductors or to release the pressed state of the transfer belt by the plurality of transfer rollers, when rotation of the transfer belt is stopped.

23. The control method according to claim 22, wherein the transfer belt braking part serves to reduce the rotational speed of a transfer belt driving motor to rotate the transfer belt.

24. The control method according to claim 22, wherein the transfer belt braking part serves to reduce the rotational speed of a driving roller to rotate the transfer belt.

* * * * *